US011542791B1

(12) United States Patent
Rosenberg et al.

(10) Patent No.: US 11,542,791 B1
(45) Date of Patent: Jan. 3, 2023

(54) SYSTEMS AND METHODS FOR CASING DRILLING SUBSEA WELLS

(71) Applicant: SUBSEA DRIVE, LLC, Sugar Land, TX (US)

(72) Inventors: Steven Michael Rosenberg, Cypress, TX (US); Kenneth James Kotow, Sugar Land, TX (US); James P. Wakefield, The Woodlands, TX (US); Nitin Maheshwar Kulkarni, Pune (IN)

(73) Assignee: SUBSEA DRIVE, LLC, Sugar Land, TX (US)

( * ) Notice: Subject to any disclaimer, the term of this patent is extended or adjusted under 35 U.S.C. 154(b) by 0 days.

(21) Appl. No.: 17/457,680

(22) Filed: Dec. 6, 2021

Related U.S. Application Data

(60) Provisional application No. 63/263,185, filed on Oct. 28, 2021, provisional application No. 63/262,450, filed on Oct. 13, 2021, provisional application No. 63/203,954, filed on Aug. 5, 2021.

(51) Int. Cl.

| | |
|---|---|
| ***E21B 7/12*** | (2006.01) |
| ***E21B 43/10*** | (2006.01) |
| ***E21B 47/06*** | (2012.01) |
| ***E21B 47/007*** | (2012.01) |

(52) U.S. Cl.
CPC ..... *E21B 43/101* (2013.01); *E21B 7/12* (2013.01); *E21B 47/007* (2020.05); *E21B 47/06* (2013.01)

(58) Field of Classification Search
CPC ..... E21B 7/12; E21B 7/20; E21B 43/101; E21B 47/001; E21B 47/06
See application file for complete search history.

(56) References Cited

U.S. PATENT DOCUMENTS 6,138,774 A * 10/2000 Bourgoyne, Jr. ..... E21B 21/001 175/7
6,826,486 B1 * 11/2004 Malinverno ..... E21B 49/006 702/9

(Continued)

OTHER PUBLICATIONS

Holasek, Fred R. et al., Determination of 20 Conductor Setting Depth Deep-Water Wells inthe Krishna-Godavari Basin Offshore India, SPE/IADC Indian Drilling Technology Conference and Exhibition, Mumbai, India, Oct. 2006.

(Continued)

*Primary Examiner* — Matthew R Buck

(74) *Attorney, Agent, or Firm* — Womble Bond Dickinson (US) LLP

(57) ABSTRACT

Systems and methods for casing drilling riserless sections of a subsea bore may include casing drilling a section of a bore for a casing of the subsea bore to a predetermined depth. The method also may include, while casing drilling the section of the bore, obtaining information indicative of pore pressure and fracture pressure of a geological formation through which the section is casing drilled, and determining a pressure range based at least in part on the pore pressure, the fracture pressure, and a modification to mechanical properties of the geological formation due to the casing drilling of the section. The method further may include selecting, based at least in part on the pressure range and the predetermined depth, a pressure of the bore for casing drilling the section.

30 Claims, 14 Drawing Sheets

(56) References Cited

U.S. PATENT DOCUMENTS

| | | | | |
|---|---|---|---|---|
| 7,334,650 | B2 * | 2/2008 | Giroux | E21B 43/105 175/57 |
| 7,784,552 | B2 | 8/2010 | Brouse | |
| 8,229,671 | B2 * | 7/2012 | Pritchard | E21B 21/08 702/6 |
| 8,499,830 | B2 | 8/2013 | Mberty | |
| 9,493,989 | B2 * | 11/2016 | Twardowski | E21B 7/208 |
| 9,580,986 | B2 | 2/2017 | Kuo et al. | |
| 10,185,786 | B2 | 1/2019 | Samuel et al. | |
| 2006/0196695 | A1 * | 9/2006 | Giroux | E21B 7/20 175/320 |
| 2012/0006567 | A1 | 1/2012 | Giroux et al. | |

OTHER PUBLICATIONS

Choe, Jonggeun et al.. Unconventional Method of Conductor Installation to Solve ShallowWater Flow Problems, SPE Annual Technical Conference and Exhibition, San Antonio, Texas, Oct. 1997.

International Search Report and Written Opinion for PCT/US2022/074370, dated Sep. 8, 2022.

* cited by examiner

SYSTEMS AND METHODS FOR CASING DRILLING SUBSEA WELLS

PRIORITY CLAIMS

This U.S. provisional patent application claims priority to and the benefit of U.S. Provisional Application No. 63/263,185, filed Oct. 28, 2021, titled "SYSTEMS AND METHODS FOR CASING DRILLING SUBSEA WELLS," U.S. Provisional Application No. 63/262,450, filed Oct. 13, 2021, titled "SYSTEMS AND METHODS FOR CASING DRILLING SUBSEA WELLS," and U.S. Provisional Application No. 63/203,954, filed Aug. 5, 2021, titled "SYSTEMS AND METHODS FOR CASING DRILLING SUBSEA WELLS," the disclosures of which are incorporated herein by reference in their entireties.

TECHNICAL FIELD

The present disclosure relates to systems and methods for drilling subsea wells and, more particularly, to systems and methods for casing drilling subsea wells.

BACKGROUND

Continuing demand for hydrocarbons including oil and natural gas has led to production of offshore hydrocarbons, sometimes at locations having increased water depths. To produce hydrocarbons at increased water depths, platforms or marine vessels supporting oil rigs and well drilling equipment may be used. Advances in platform and marine vessel technology have increased the loads the platforms or marine vessels may safely use, and drilling strings, which may be generally formed of jointed steel pipe, are capable of drilling wells to increased water and formation depths.

In deepwater drilling, riserless drilling may be performed. In riserless drilling, no return conduit or riser is used between the wellbore and the drilling structure or marine vessel, for example, at the surface of the body of water in which the drilling is occurring. As a result, the drill cuttings, fluids and other by-products of the drilling process may be discharged to the seafloor and are typically swept away by currents.

In some current riserless drilling processes, a first casing, which may typically have a length ranging from about 250 feet to 350 feet below the mudline, may be lowered from the platform or marine vessel and "jetted" into place into the seafloor. According to current subsea drilling philosophy, the purpose of the first casing and corresponding first casing seat placement is to provide structural support for the weight of subsequent casing strings extending deeper into the geological formation and the wellhead, and/or to support the bending moment of a riser wellhead assembly and blow-out preventers, which may be eventually attached to the first casing. In addition, according to current practice, the casing seat for the first casing may often be set well above geological hazards to avoid drilling or wellbore problems sometimes created by geological hazards. As a result, under such practice the presence and depth locations of geological hazards may often be considered when selecting the depth locations of casing seats for subsequent casings. Applicant has recognized, however, that current practice may often result in the first casing being placed at too shallow of a depth in the geological formation to successfully achieve the intended purpose of the first casing of resolving unstable formations and geological drilling hazards, and further, may result in a relatively high number of casings, which may create undesirable drilling conditions and reduce hydrocarbon production from the well.

For example, the relatively shallow location of the depth of the first casing may result in not providing sufficient leak-off tolerance for drilling a next section of the wellbore in the geological formation. At relatively shallow depths, the geological formation may often be relatively soft. As a result, at the depth of the first casing, the geological formation may provide insufficient resistance for fracture resistance and leak-off. In addition, the ability of the first casing to support axial loads may be limited and may thus result in a structural failure hazard, for example, if there is insufficient soil-bearing strength for supporting the wellhead and additional deeper casings or supporting the bending load from a riser. Moreover, by terminating the first casing at a relatively shallow depth below the mudline, an increased number of additional casings may be required to reach the intended depth of the wellbore to provide the desired production of hydrocarbons. Further, under current practice, casing seats may be provided above most or all anticipated geological or drilling hazards, sometimes resulting in even more casing seats and corresponding casings. The relatively increased number of subsequent casings necessary to reach the intended depth of the wellbore may result in reducing the cross-sectional area of the deepest casings because each deeper casing necessarily has a smaller diameter than the casing located immediately above it. This may create sufficiently small annuli causing high drilling fluid friction preventing further drilling. This results in "wasting" casing diameters. As the casing diameters decrease, it becomes more difficult to drill the well and produce the hydrocarbons from the geological formation, potentially limiting the value of the well.

Accordingly, Applicant has recognized a need to provide improved subsea drilling systems and methods that may result in improved hydrocarbon production, for example, by improving the placement of casings and/or the reliability of wellbores, for example, in deepwater drilling and hydrocarbon production operations. The present disclosure may address one or more of the above-referenced drawbacks, as well as other possible drawbacks.

SUMMARY

As referenced above, it may be desirable to provide improved subsea drilling systems and methods that may result in decreased drilling costs and improved hydrocarbon production, for example, by improving the placement of casings, increasing the reliability of wellbores, for example, in deepwater drilling and hydrocarbon production operations. Current practices may often result in first casings that provide insufficient structural support, insufficient resistance for fracture resistance and leak-off, and/or narrowed casing cross-sections, impeding the attainment of well objectives and hindering hydrocarbon production.

The present disclosure generally is directed to systems and methods for subsea casing drilling that provide enhanced casing seat location, improved structural and bending moment support for wellheads and casings, and/or improved wellbore fracture resistance and leak-off mitigation. Rather than arbitrarily setting casing seat depths or setting casing seat depths based on the depth locations of known geological hazards, in some embodiments, the systems and methods may result in improved or optimized casing seat placement to mitigate shallow drilling hazards. In some embodiments, the first casing may be positioned in the geological formation at relatively greater depths as compared to current practice. By positioning the first casing at a relatively greater depth, in some embodiments, the first casing may provide enhanced axial support for wellheads and additional casings and/or enhanced resistance to bending loads. Enhanced axial support may provide a more stable platform for a blow-out preventer and/or other well control equipment, which, in turn, may facilitate correction or mitigation of any loss-of-well-control events, for example, in contrast to conventional subsea drilling practices that may result in insufficient structural support for wellheads, blow-out preventers, or other well control equipment, which may lead to difficulty correcting or mitigating loss-of-well-control events, potentially resulting in undesirable release of materials into the surrounding environment. Further, by positioning the first casing at a relatively greater depth, in some embodiments, fewer subsequent casings may be required to reach the desired total depth of the wellbore. By using fewer subsequent casings, in some embodiments, the diameters of the final, deepest casings may be relatively greater as compared to the diameters of casings in current practice. Moreover, in some embodiments, the first casing may be positioned at a depth below geological hazards and in some instances, at a depth of the geological formation having a sufficient fracture gradient. This may permit the placement of subsequently installed casings to traverse the geological formation to greater depths. For example, the depth of each of the subsequently installed casings may be positioned at respective depths based at least partially or fully on the physical properties of the geological formation, such as corresponding pore pressure values and/or corresponding fracture pressure values of portions of the geological formation through which the casings traverse.

In some embodiments, a method for casing drilling riserless sections of a subsea well may include casing drilling a section of a wellbore for a casing of the subsea well to a predetermined depth. The method also may include, while casing drilling the section of the wellbore, obtaining information indicative of pore pressure and fracture pressure of a geological formation through which the section is casing drilled, and determining a pressure range based at least in part on the pore pressure, the fracture pressure, and a modification to mechanical properties of the geological formation due to the casing drilling of the section. The method further may include selecting, based at least in part on the pressure range and the predetermined depth, a pressure of the wellbore for casing drilling the section.

In some embodiments, a method for casing drilling riserless sections of a subsea well may include casing drilling a first section of a wellbore for a structural casing through a geological hazard to a predetermined depth. The method further may include, while casing drilling the first section of the wellbore, obtaining information indicative of a pore pressure of a geological formation through which the first section is casing drilled, and selecting the predetermined depth based at least in part on the pore pressure and a modification to a fracture pressure of the wellbore following smearing of drill cuttings into a wall of the first section due to the casing drilling.

In some embodiments, a method for casing drilling riserless sections of a subsea well in a geological formation may include casing drilling a section of the subsea well from a surface to a depth that is below at least one geological hazard in the geological formation. The method also may include, while casing drilling the section, modifying a wall of a wellbore of the section to obtain an increased fracture pressure of the geological formation along the section. The method further may include, while casing drilling the section, maintaining a pressure in the wellbore of the section between a pore pressure of the section and the increased fracture pressure. The method still further may include, while casing drilling the section, identifying the depth based at least in part on the increased fracture pressure along the section.

In some embodiments, a method for planning casing drilling of a subsea well may include obtaining a pore pressure and a fracture pressure of a geological formation through which a portion of the subsea well will traverse. The method further may include selecting, for a section of the subsea well, casing drilling for drilling the section, and identifying a pressure range for the section based at least in part on the pore pressure, the fracture pressure, and a modification to mechanical properties of the geological formation due to the casing drilling. The method also may include selecting, based at least in part on the pressure range, a depth of an end point for the section of the subsea well, and a pressure to maintain the section of the subsea well while casing drilling the section.

In some embodiments, a subsea well casing drilling assembly may include a casing string including a tubular wall to provide a barrier between a flow of hydrocarbons from a subsea geological formation and a wellbore traversing a portion of the subsea geological formation. The subsea well casing drilling assembly further may include a drive assembly received in the casing string. The drive assembly may include a driven interface positioned to be connected to a running string supported by a drilling rig including rotating equipment positioned to rotate the running string. The driving assembly further may include a casing interface connected to an interior surface of the casing string and positioned to transfer rotation between the drive assembly and the casing string. The driving assembly also may include a cementing string interface positioned to be connected to a cementing string, and a tubular drive body extending at least partially between the driven interface and the cementing string interface and being positioned to receive drilling fluids therethrough. The subsea well casing drilling assembly further may include a cementing string connected to the cementing string interface and positioned to provide fluid flow between the drive assembly and a terminal end of the casing string. The subsea well casing drilling assembly also may include a casing bit connected to the terminal end of the casing string. The casing bit may be positioned to rotate with the casing string and drill into the geological formation to form a wellbore traversing a section of the geological formation. The subsea well casing drilling assembly still further may include one or more drilling sensors positioned to generate one or more drilling signals indicative of one or more of pressure, flow rate, temperature, bore depth (e.g., well depth), formation properties, or lithology, and a drilling controller in communication with one or more of the drilling rig, the drive assembly, or the one or more drilling sensors. The drilling controller may be configured to receive the one or more drilling signals from the one or more drilling sensors, and determine, based at least in part on the one or more drilling signals, information indicative of pore pressure and fracture pressure of a geological formation through which a section of a wellbore for a casing of a subsea well is being casing drilled to a predetermined depth. The drilling controller also may be configured to determine a pressure range based at least in part on the pore pressure, the fracture pressure, and a modification to mechanical properties of the geological formation due to the casing drilling of the section, and select, based at least in part on the pressure range and the predetermined depth, a pressure of the wellbore for casing drilling the section. The drilling controller further may be configured to at least partially control one or more of the rotating equipment or the drive assembly to casing drill the section of the wellbore to the predetermined depth.

In some embodiments, a subsea casing drilling assembly to provide a bore traversing a portion of a subsea geological formation may include a drive assembly positioned to be received in a casing string. The drive assembly may include a driven interface positioned to be connected to a running string supported by a drilling rig including rotating equipment positioned to rotate the running string. The drive assembly further may include a casing interface positioned to be connected to an interior surface of the casing string and positioned to transfer rotation between the drive assembly and the casing string. The drive assembly also may include a cementing string interface positioned to be connected to a cementing string, and a tubular drive body extending at least partially between the driven interface and the cementing string interface and being positioned to receive drilling fluids therethrough. The subsea casing drilling assembly further may include a cementing string connected to the cementing string interface and positioned to provide fluid flow between the drive assembly and a terminal end of the casing string. The subsea casing drilling assembly also may include a casing bit positioned to be connected to a terminal end of the casing string, the casing bit being positioned to rotate with the casing string and drill into the geological formation to form a bore traversing a section of the geological formation.

In some embodiments, a method for casing drilling a subsea bore may include casing drilling a section of a bore for a casing of the subsea bore to a predetermined depth. The method further may include, while casing drilling the section of the bore, obtaining information indicative of pore pressure and fracture pressure of a geological formation through which the section is casing drilled, and determining a pressure range based at least in part on the pore pressure, the fracture pressure, and a modification to mechanical properties of the geological formation due to the casing drilling of the section. The method also may include selecting, based at least in part on the pressure range and the predetermined depth, a pressure of the bore for casing drilling the section.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than can be necessary for a fundamental understanding of the embodiments discussed herein and the various ways in which they can be practiced. According to common practice, the various features of the drawings discussed below are not necessarily drawn to scale. Dimensions of various features and elements in the drawings can be expanded or reduced to more clearly illustrate embodiments of the disclosure.

DETAILED DESCRIPTION

The drawings include like numerals to indicate like parts throughout the several views, the following description is provided as an enabling teaching of exemplary embodiments, and those skilled in the relevant art will recognize that many changes may be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances. Thus, the following description is provided as illustrative of the principles of the embodiments and not in limitation thereof.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Figure 1:
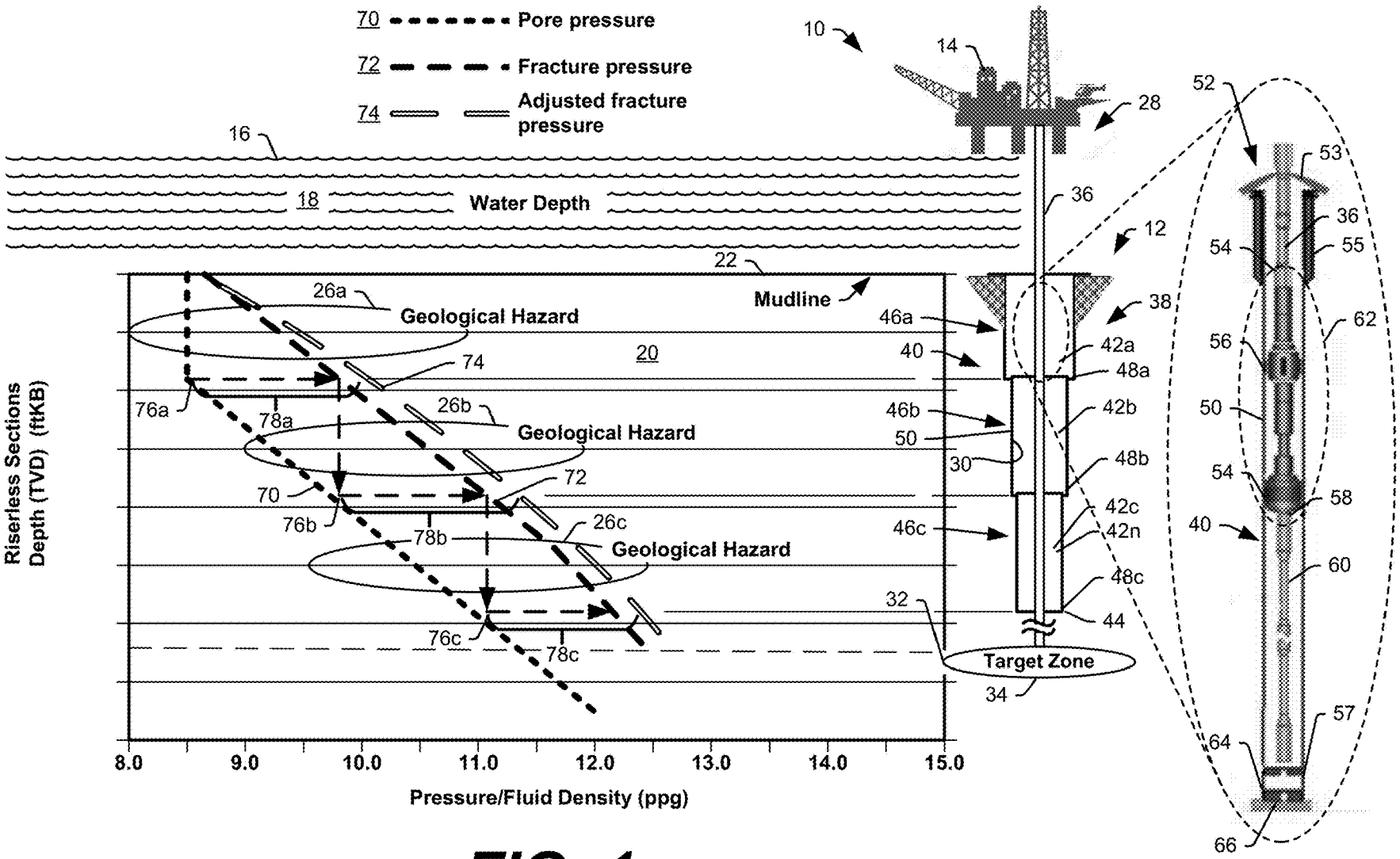
FIG. 1 schematically illustrates an example subsea well casing drilling operation and includes a graphical depiction of true vertical depth (TVD) versus pressure showing example casing seat placement and casings relative to true vertical depth and pore pressure and fracture pressure using an example subsea well casing drilling assembly, according to embodiments of the disclosure.

FIG. 1 schematically illustrates an example subsea well casing drilling operation 10 and includes a graphical depiction of true vertical depth (TVD) (ftKB) versus pressure (ppg) showing example casing seat placement and casings relative to true vertical depth, pore pressure, fracture pressure, and adjusted fracture pressure using an example subsea well casing drilling assembly 12, according to embodiments of the disclosure. In some embodiments, this may be applicable to riserless casings, although other applications are contemplated. As shown in FIG. 1, the example drilling operation 10 may include a drilling rig 14 at the surface 16 of a body of water 18, such as an ocean, a sea, a lake, a river, a gulf, or other body of water at the location of a geological formation 20 at which the drilling operation 10 will take place. The drilling rig 14 may include any type of drilling rig used for subsea drilling, deepwater subsea drilling, or ultra-deepwater subsea drilling at a body of water, such as, for example, a fixed platform rig, a semi-submersible platform, a jack-up drilling rig, a drillship, a floating drilling rig, or a tension-leg platform. Other types of drilling rigs are contemplated as will be understood by those skilled in the art. In some embodiments, the casing drilling operation 10 and related methods may be used to casing drill subsea bores that are not wellbores. For example, the casing drilling operation 10 and related methods may be used to casing drill subsea bores that may be used for receipt of one or more subsea structures, such as, for example, concrete footers and/or other structures for support of undersea structures, such as supports for undersea buildings, bridge pilings, wind turbines, etc.

In the example shown in FIG. 1, the example geological formation 20 includes a mudline 22. The mudline 22 may begin at any true vertical depth below the surface 16 of the body of water 18, such as, for example, a true vertical depth ranging from about 100 feet or less to about 15,000 feet or more (e.g., from about 1,000 feet to about 10,000 feet, from about 2,000 feet to about 8,000 feet, from about 3,000 feet to about 6,000 feet, or from about 3,000 feet to about 5,000 feet (e.g., about 3,500 feet)). These depth ranges are merely examples. In some embodiments, the casing drilling operation 10 and related methods may be used to casing drill subsea bores extending from the mudline 22 into the geological formation 22 to a true vertical depth ranging, for example, from about 100 feet or less to about 15,000 feet or more, (e.g., from about 1,000 feet to about 10,000 feet, from about 2,000 feet to about 9,000 feet, from about 3,000 feet to about 8,000 feet, or from about 3,000 feet to about 7,000 feet (e.g., about 6,700 feet)). These depth ranges are merely examples.

For example, the mudline 22 may begin at a true vertical depth of about 3,500 feet below the surface 16 of the body of water 18. Consistent with such an example, the example geological formation 20 shown in FIG. 1 also includes three geological hazards 26*a*, 26*b*, and 26*c* centered at respective true vertical depths of about 4,000 feet, 5,000 feet, and 6,000 feet below the surface 16, each extending about 500 feet of true vertical depth as examples. The geological hazards 26, 26*b*, and/or 26*c* may include any known geological hazards, such as, for example, shallow drilling hazards, hydrocarbon hazards, frozen methane, trapped oil, trapped gas, or water flows, such as fresh water flows or salt water flows. Other types of geological hazards at other depths are contemplated as will be understood by those skilled in the art.

As shown in FIG. 1, the drilling operation 10 may use a drilling rig assembly 28 to drill a wellbore 30 in the geological formation 20 from the mudline 22 to a predetermined depth 32. In some embodiments, the predetermined depth 32 may generally correspond to the true vertical depth at which a geohazard may be present in the geological formation 20. In some embodiments, the predetermined depth 32 may be based at least in part on, for example, a fracture pressure gradient prediction, a pore pressure gradient prediction, and/or predicted soil mechanical strength, for example, for wind turbine and/or subsea structure foundation depths, although other bases for the predetermined depth 32 are contemplated. The drilling operation 10 may drill a wellbore 30 to a target zone 34. The drilling rig 14 may include rotating equipment for rotating a running string 36, which may extend between the drilling rig 14 and the subsea well casing drilling assembly 12, for example, as shown in FIG. 1. As explained in more detail herein, the subsea well casing drilling assembly 12 may be used to drill the wellbore 30 and install one or more well casings. The rotating equipment and/or the running string 36 may include any known types of rotating equipment and/or running strings as will be understood by those skilled in the art. In the example shown in FIG. 1, the drilling rig assembly 28 may be used to install a well assembly 38 including a casing string 40, which may include a plurality of casings 42*a* through 42*n* and a terminal end 44 extending to the target zone 34. For example, as shown in FIG. 1, the casing string 40 may include a first casing 42*a*, a second casing 42*b*, and a third casing 42*c* (i.e., a casing 42*n* where n equals 3). The target zone 34 may include or contain, for example, resources such as hydrocarbons, non-hydrocarbon gases, minerals, and/or other natural resources associated with the geological formation.

In some embodiments, the first casing 42*a* may be a structural casing, for example, configured to provide axial support for wellheads and additional casings and/or enhanced resistance to bending loads, for example, caused by a riser and other wellhead-related equipment, such as, for example, a riser and/blowout prevention/well control equipment. As shown in FIG. 1, the first casing 42*a* may extend through or traverse a first wellbore section 46*a* in the geological formation 20, a second casing 42*b* may extend through or traverse a second wellbore section 46*b* in the geological formation 20, and the third casing 42*c* may extend through or traverse a third wellbore section 46*c* in the geological formation 20. As shown in FIG. 1, in some embodiments, the well assembly 38 also may include a plurality of casing seats 48*a* through 48*n* corresponding to each of the casings 42*a* through 42*n* and at least partially supporting a corresponding one of the casings 42*a* through 42*n*. As shown in FIG. 1, for example, the second casing 42*b* may be supported by a first casing seat 48*a*, and the third casing 42*c* may be supported by a second casing seat 48*b*. In embodiments having a fourth casing, the third casing seat 48*c* may support the fourth and remaining casings. More or fewer casings, casing seats, and/or wellbore sections are contemplated, as will be understood by those skilled in the art.

As shown in FIG. 1, the example first casing seat 48*a* is located at a true vertical depth of about 4,400 feet, the example second casing seat 48*b* is located at a true vertical depth of about 5,400 feet, and the third casing seat 48*c* is located at a true vertical depth of about 6,400 feet. These depths are merely examples, and other depths are contemplated as will be understood by those skilled in the art. In some embodiments, the systems and methods described herein may result in improved placement or optimized placement of one or more casing seats of a well assembly. In some embodiments, each application of the system may vary the number of casing strings in riserless sections.

As shown in FIG. 1, in some embodiments, the subsea well casing drilling assembly 12 may include a casing string 40 (or section thereof), including a tubular wall 50 (e.g., a hollow cylindrical tubular wall) configured to provide a barrier between a flow of materials of the target zone 34 from the geological formation 20 and a wellbore 30 traversing a portion of the geological formation 20. The casing drilling assembly 12 further may include a drive assembly 52 received in the casing string 40. The drive assembly 52 may include a driven interface 54 positioned to be connected to the running string 36 supported by the drilling rig 14 and rotated by the rotating equipment on the drilling rig 14. The drive assembly 52 further may include a casing interface 56 connected to an interior surface of the casing string 40 and positioned to transfer rotation between the drive assembly 52 and the casing string 40. The drive assembly 52 also may include a cementing string interface 58 connected to a cementing string 60, and a drive body 62 extending at least partially between the driven interface 54 and the cementing string interface 58 and being configured to receive drilling fluids therethrough. The casing drilling assembly 12 further may include a cementing string 60 connected to the cementing string interface 58 and positioned to provide fluid flow between the drive assembly 52 and a terminal end 64 of the casing string 40. The casing drilling assembly 12 still further may include a casing bit 66 connected to the terminal end 64 of the casing string 40. The casing bit 66 may be configured to rotate with the casing string 40 and drill into the geological formation 20 to form the wellbore 30, which traverses a section of the geological formation 20. In some embodiments, the casing drilling assembly 12 further may include a debris barrier 53 configured to prevent drilling debris from entering the drive assembly 52. In some embodiments, a low pressure housing 55 (e.g., a low-pressure wellhead housing assembly) may be provided adjacent the debris barrier 53. As shown in FIG. 1, some embodiments may include a cementing float and shoe track 57, for example, adjacent the casing bit 66. One or more sections of the casing string 40 may be left in place upon completion of the drilling operation, as will be understood by those skilled in the art.

As explained herein, in some embodiments, the systems and methods according to embodiments described herein may result in installation of casing seats and corresponding casings at greater true vertical depths as compared to installation of casing seats and casings according to current practice. By installing the first casing 42*a* (e.g., a structural casing) at a relatively greater depth in the geological formation 20, fewer lower or subsequent casings and/or contingency casing strings may be needed at deeper true vertical depths to drill the wellbore 30 to the desired true vertical depth to reach the target zone. As noted herein, reducing the number of casings may result in a relatively greater diameter at the deepest casing or casings as compared to casing strings conventionally installed and including a greater number of casings, at least because each subsequent and deeper casing necessarily has a smaller diameter than the casing(s) above it. Thus, reducing the number of casings may result in increasing the diameter of the wellbore 30 in deeper sections of the well. In some embodiments, for example, the depth of the first casing 42*a* may be set at a true vertical depth approaching or corresponding to a depth of the geological formation 20 at which the fracture gradient and/or fracture pressure remains sufficient to safely drill, which potentially may be well below any possible geological hazards. This, in turn, may enable subsequently installed (i.e., deeper) casings (e.g., riserless casings) to traverse the geological formation to greater depths, for example, with one or more (e.g., each) of those depths being determined based at least in part (e.g., only) on the physical properties of the geological formation 20, which may include, for example, the pore pressure and/or the fracture pressure or fracture gradient of the geological formation 20 through which the casings traverse. In contrast, according to current practice of setting casing depths, the presence of geological hazards is considered and, in some instances, may be determinative, when selecting the casing seat depth of the structural casing and subsequent deeper casings, which may result in the casing seat of the structural casing being located at a depth significantly above many geological hazards and/or the casing seats of subsequent deeper casings being located at respective depths significantly above other geological hazards.

In some embodiments, the systems and methods disclosed herein may include the use of the casing drilling assembly 12, which may include the above-noted drive assembly 52. For example, in some embodiments, the casing drilling assembly 12 may be used for riserless subsea drilling operations. The casing drilling assembly 12 may include the drive assembly 52 within the casing string 40, and the drive assembly 52 may include the casing interface 56 connected to the interior surface of the casing string 40 and configured to transfer rotation between the drive assembly 52, driven by the running string 36 from the drilling rig 14, and the casing string 40. In some embodiments, the casing drilling assembly 12 may enable casing drilling (e.g., rotating the casing string 40 connected to the casing bit 68 to drive the casing bit 68, for example, rather than a drill string) of the wellbore 30 to be performed below the mudline 22. For example, the casing drilling assembly 12 (e.g., via the drive assembly 52) may transmit casing rotation initiated by rotation equipment on the drilling rig 14 to the casing string 40 in the wellbore 30 to rotate the casing string 40 linked to the casing bit 68. In some embodiments, by rotating the casing string 40 while drilling, the structural integrity of the geological formation 20 through which the first and/or subsequent casing(s) traverse(s) may be improved, for example, by smearing drill cuttings into the wall of the casing drilled wellbore 30, for example, resulting from the relatively larger diameter of the casing as compared to the diameter of a drill pipe. Improving the structural integrity of the geological formation 20 may result in mitigating dangers often associated with of geological hazards through which the first casing traverses, and in some embodiments, while also improving the strength of the geological formation 20. Further, in some embodiments, because the first casing seat associated with the first casing is set at a true vertical depth below geological hazard, which may often be at a true vertical depth immediately below the mudline, it may be possible to position subsequently installed casing seats based at least partially on or solely on properties of the geological formation 20 at the respective true vertical depths, such as, for example, the pore pressure and/or fracture pressure or fracture gradient, rather than being solely based on the depth of the geological hazards.

The pore pressure of the geological formation 20 may vary with true vertical depth and may be the amount of pressure or stress expressed in pounds per square inch (or other force per unit area units) per true vertical distance of well depth (e.g., per foot or other length unit) transmitted through the interstitial fluid of a soil or rock mass. The fracture pressure or fracture gradient may be the amount of pressure expressed in pounds per square inch (or other force per unit area units) per true vertical distance of well depth (e.g., per foot or other length unit) that is required to induce fractures in the geological formation 20 at a given true vertical depth.

In some embodiments, prior to and/or during drilling of the well, measurements and/or estimations of the mechanical properties of the geological formation 20 being drilled may be taken, including, for example, the pore pressure and the fracture pressure. These properties may be used to identify pressure ranges over which a borehole of the wellbore 30 may be pressurized for drilling purposes without significantly risking damage to the wellbore 30 and/or a loss of drilling fluid. For example, damage to the wellbore 30 may include fracturing the geological formation 20 in an undesired way. Loss of drilling fluid may result from a portion of the drilling fluid escaping from the wellbore 30 into the surrounding geological formation 20. In some embodiments, the measured and/or estimated properties of the geological formation 20 may be adjusted to factor-in any changes to the mechanical properties that may result from the drilling operation. For example, in some embodiments, the pore pressure and/or the fracture pressure may be adjusted and/or corrected based at least in part on likely changes to the properties of the geological formation 20 at least partially resulting from the smearing of drill cuttings into the wall of the wellbore 30 during the casing drilling operation. In some embodiments, drilling fluid loss may be determined and/or estimated during the drilling operation, for example, based at least in part on pressure drop and/or observation of a reduction of drill cuttings being circulated to the mudline 22. For example, the above-noted pressure range may be determined based at least in part on likely changes to the pore pressure and/or fracture pressure of the geological formation 20 due to smearing of the drill cuttings. The pressure range may include the range of pressures that lie between the adjusted or corrected pore pressure and/or the adjusted or corrected fracture pressure. In some embodiments, the respective depths at which one or more of the casing seats may be positioned may be determined based at least in part on the pressure range. In some embodiments, one or more pressures at which to maintain the well while drilling may be determined based at least in part on the pressure range (e.g., to remain within the pressure range).

For example, referring to FIG. 1, the graph schematically shows a pore pressure curve 70, a fracture pressure curve 72, and an adjusted or corrected fracture pressure curve 74, each for an example geological formation 20 as a function of true vertical depth, which is shown on the Y-axis, and in relation to the surface 16 of the body of water 18, the drilling rig 14, the example geological hazards 26*a*, 26*b*, and 26*c*, and the target zone 34. According to some embodiments, a method for casing drilling the subsea well may include casing drilling a first section 46*a* of the wellbore 30 to a first predetermined depth 76*a*, for example, using the casing drilling assembly 12 described herein. The first predetermined depth 76*a* may correspond generally to the true vertical depth at which the pore pressure 70 begins to increase with true vertical depth, for example, as shown in FIG. 1. The method also may include, while casing drilling the first section 46*a* of the wellbore 30, obtaining information indicative of pore pressure 70 and fracture pressure 72 of a geological formation 20 through which the first section 46*a* is drilled. In some embodiments, this may be determined prior to drilling and/or by using one or more sensors configured to generate signals indicative of conditions and/or parameters associated with the casing drilling, such as, for example, one or more pressure sensors configured to generate signals indicative of pressure associated with the drilling fluid and/or the geological formation 20, one or more flow meters configured to generate signals indicative of the flow rate of the flow of drilling fluid, and/or one or more temperature sensors configured to generate signals indicative of temperature associated with the drilling fluid and/or geological formation 20, etc.

As noted herein, casing drilling the first section 46*a* of the wellbore 30 may result in changing the mechanical properties of first section 46*a*. For example, the pore pressure 70 and/or the fracture pressure 72 may be increased as a result of the smearing of drill cuttings into the wall of the first section 46*a* of the wellbore 30 during the casing drilling operation. This example phenomenon may be represented by the adjusted or corrected fracture pressure curve 74 shown in FIG. 1. A first pressure range 78*a* associated with casing drilling the first section 46*a* of the wellbore 30 may be determined, for example, based at least in part on the pore pressure 70, the fracture pressure 72, and/or the modification or correction to mechanical properties of the geological formation 20 due to the casing drilling of the first section 46*a*. In some embodiments, the adjusted or corrected fracture pressure 74 may be used to determine the first pressure range 78*a*. For example, the first pressure range 78*a* may be determined based at least in part on the pore pressure 70, the fracture pressure 72, and/or the adjusted or corrected fracture pressure 74 of the geological formation 20, for example, at the first section 46*a* of the wellbore 30 formed by the casing drilling of the first section 46*a* of the wellbore 30. Based at least in part on the first pressure range 78*a* and the first predetermined depth 76*a*, a pressure for drilling the first section 46*a* of the wellbore 30 may be selected. In some embodiments, the pressure for drilling the first section 46*a* may be a pressure above the pore pressure 70 and below the fracture pressure 72 at the first predetermined depth 76*a*. In some embodiments, the pressure for casing drilling the first section 46*a* may be a pressure above the pore pressure 70 and below the adjusted or corrected fracture pressure 74 at the first predetermined depth 76*a* of the wellbore 30. This may reduce the likelihood or prevent the pressure during the casing drilling the first section 46*a* from structurally compromising and/or damaging the wellbore 30 in the first section 46*a*.

In some embodiments, as schematically shown in FIG. 1, a first casing seat 48*a* may be placed at the first predetermined depth 76*a*. For example, as shown in FIG. 1, the first casing seat 48*a* may be placed at a true vertical depth of about 4,440 feet. As shown in FIG. 1, this may be significantly below the first geological hazard 26*a*. In current practice, a first casing seat for a structural casing might be positioned above the first geological hazard 26*a*, resulting in the first casing seat being located at a true vertical depth of about 3,750 feet in the example shown in FIG. 1. Thus, setting the depth of the first casing 48*a* at the first predetermine depth 76*a* according to embodiments of the disclosure may result the first casing seat 48*a* being significantly deeper as compared to current practice. In addition, in some embodiments, by determining the first casing seat 48*a* depth in the above-described example manner, the chances of exceeding the fracture pressure 72 during casing drilling may be significantly reduced.

Once the first casing seat 48*a* has been positioned at the first predetermined depth 76*a*, a second section 46*b* may be casing drilled to a second predetermined depth 76*b*, for example, using the casing drilling assembly 12 described herein. For example, in some embodiments, as schematically shown in FIG. 1, the second predetermined depth 76*b* may correspond to a true vertical depth at which the pore pressure 70 is substantially equal to the fracturing pressure 72 (or the adjusted or corrected fracturing pressure 74) at the first predetermined depth 76*a*. In some embodiments, while casing drilling the second section 46*b* of the wellbore 30, information may be obtained indicative of the pore pressure 70 and/or the fracture pressure 72 of a geological formation 20 through which the second section 46*b* is drilled. This information may be previously obtained and/or measured during the casing drilling of the second section 46*b*, for example, as described above with respect to the casing drilling of the first section 46*a* of the wellbore 30.

In some embodiments, a second pressure range 78*b* associated with casing drilling the second section 46*b* of the wellbore 30 may be determined, for example, based at least in part on the pore pressure 70, the fracture pressure 72, and/or the modification or correction to mechanical properties of the geological formation 20 due to the casing drilling of the second section 46*b*. In some embodiments, the adjusted or corrected fracture pressure 74 may be used to determine the second pressure range 78*b*. For example, the second pressure range 78*b* may be determined based at least in part on the pore pressure 70, the fracture pressure 72, and/or the adjusted or corrected fracture pressure 74 of the geological formation 20, for example, at the second section 46*b* of the wellbore 30 formed by the casing drilling of the second section 46*b* of the wellbore 30. Based at least in part on the second pressure range 78*b* and the second predetermined depth 76*b*, a pressure for drilling the second section 46*b* of the wellbore 30 may be selected. In some embodiments, the pressure for drilling the second section 46*b* may be a pressure above the pore pressure 70 and below the fracture pressure 72 at the second predetermined depth 76*b*. In some embodiments, the pressure for casing drilling the second section 46*b* may be a pressure above the pore pressure 70 and below the adjusted or corrected fracture pressure 74 at the second predetermined depth 76*b* of the wellbore 30. This may reduce the likelihood or prevent the pressure during the casing drilling the second section 46*b* from compromising the stability and/or damaging the wellbore 30 in the second section 46*b*.

In some embodiments, as schematically shown in FIG. 1, a second casing seat 48*b* may be placed at the second predetermined depth 76*b*. For example, as shown in FIG. 1, the second casing seat 48*b* may be placed at a true vertical depth of about 5,440 feet. As shown in FIG. 1, this may be significantly below the second geological hazard 26*b*. In current practice, casing seats below the casing seat for the structural casing might be positioned above the second geological hazard 26*b*, resulting in the second casing seat 48*b* being located at a true vertical depth of about 4,750 feet in the example shown in FIG. 1. Thus, setting the depth of the second casing 48*b* at the second predetermine depth 76*b* according to embodiments of the disclosure may result the second casing seat 48*b* being significantly deeper as compared to current practice. In addition, in some embodiments, by determining the second casing seat 48*b* depth in the above-described example manner, the chances of exceeding the fracture pressure 72 during casing drilling may be significantly reduced.

Once the second casing seat 48*b* has been positioned at the second predetermined depth 76*b*, a third section 46*c* of the wellbore 30 may be casing drilled to a third predetermined depth 76*c*, for example, using the casing drilling assembly 12 described herein. For example, in some embodiments, as schematically shown in FIG. 1, the third predetermined depth 76*c* may correspond to a true vertical depth at which the pore pressure 70 is substantially equal to the fracturing pressure 72 (or the adjusted or corrected fracturing pressure 74) at the second predetermined depth 76*b*. In some embodiments, while casing drilling the third section 46*c* of the wellbore 30, information may be obtained indicative of the pore pressure 70 and/or the fracture pressure 72 of a geological formation 20 through which the third section 46*c* is drilled. This information may be previously obtained and/or measured during the casing drilling of the third section 46*c*, for example, as described above with respect to the casing drilling of the first section 46*a* of the wellbore 30.

In some embodiments, a third pressure range 78*c* associated with casing drilling the third section 46*c* of the wellbore 30 may be determined, for example, based at least in part on the pore pressure 70, the fracture pressure 72, and/or the modification or correction to mechanical properties of the geological formation 20 due to the casing drilling of the third section 46*c*. In some embodiments, the adjusted or corrected fracture pressure 74 may be used to determine the third pressure range 78*c*. For example, the third pressure range 78*c* may be determined based at least in part on the pore pressure 70, the fracture pressure 72, and/or the adjusted or corrected fracture pressure 74 of the geological formation 20, for example, at the third section 46*c* of the wellbore 30 formed by the casing drilling of the third section 46*c* of the wellbore 30. Based at least in part on the third pressure range 78*c* and the third predetermined depth 76*c*, a pressure for drilling the third section 46*c* of the wellbore 30 may be selected. In some embodiments, the pressure for drilling the third section 46*c* may be a pressure above the pore pressure 70 and below the fracture pressure 72 at the third predetermined depth 76*c*. In some embodiments, the pressure for casing drilling the third section 46*c* may be a pressure above the pore pressure 70 and below the adjusted or corrected fracture pressure 74 at the third predetermined depth 76*c* of the wellbore 30. This may reduce the likelihood or prevent the pressure during the casing drilling the third section 46*c* from compromising the stability and/or damaging the wellbore 30 in the third section 46*b*.

In some embodiments, as schematically shown in FIG. 1, a third casing seat 48*c* may be placed at the third predetermined depth 76*c*. For example, as shown in FIG. 1, the third casing seat 48*c* may be placed at a true vertical depth of about 6,440 feet. As shown in FIG. 1, this may be significantly below the third geological hazard 26*c*. In current practice, casing seats below the casing seat for the structural casing might be positioned above the third geological hazard 26*c*, resulting in the third casing seat being located at a true vertical depth of about 5,750 feet in the example shown in FIG. 1. Thus, setting the depth of the third casing 48*c* at the third predetermined depth 76*c* according to embodiments of the disclosure may result the third casing seat 48*c* being significantly deeper as compared to current practice. In addition, in some embodiments, by determining the third casing seat 48*c* depth in the above-described example manner, the chances of exceeding the fracture pressure 72 during casing drilling may be significantly reduced.

The above-outlined example procedures for casing drilling the first casing 42*a*, the second casing 42*b*, and/or the third casing 42*c*, and/or the determining the respective depths of the first casing seat 48*a*, the second casing seat 48*b*, and/or the third casing seat 48*c*, may be repeated for additional casings and/or casing seats, for example, until the depth of the target zone 34 has been reached (or a desired depth has been reached). Once the depth of the target zone 34 or desired depth has been reached, the drilling operation may be continued as will be understood by those skilled in the art.

Figure 2:
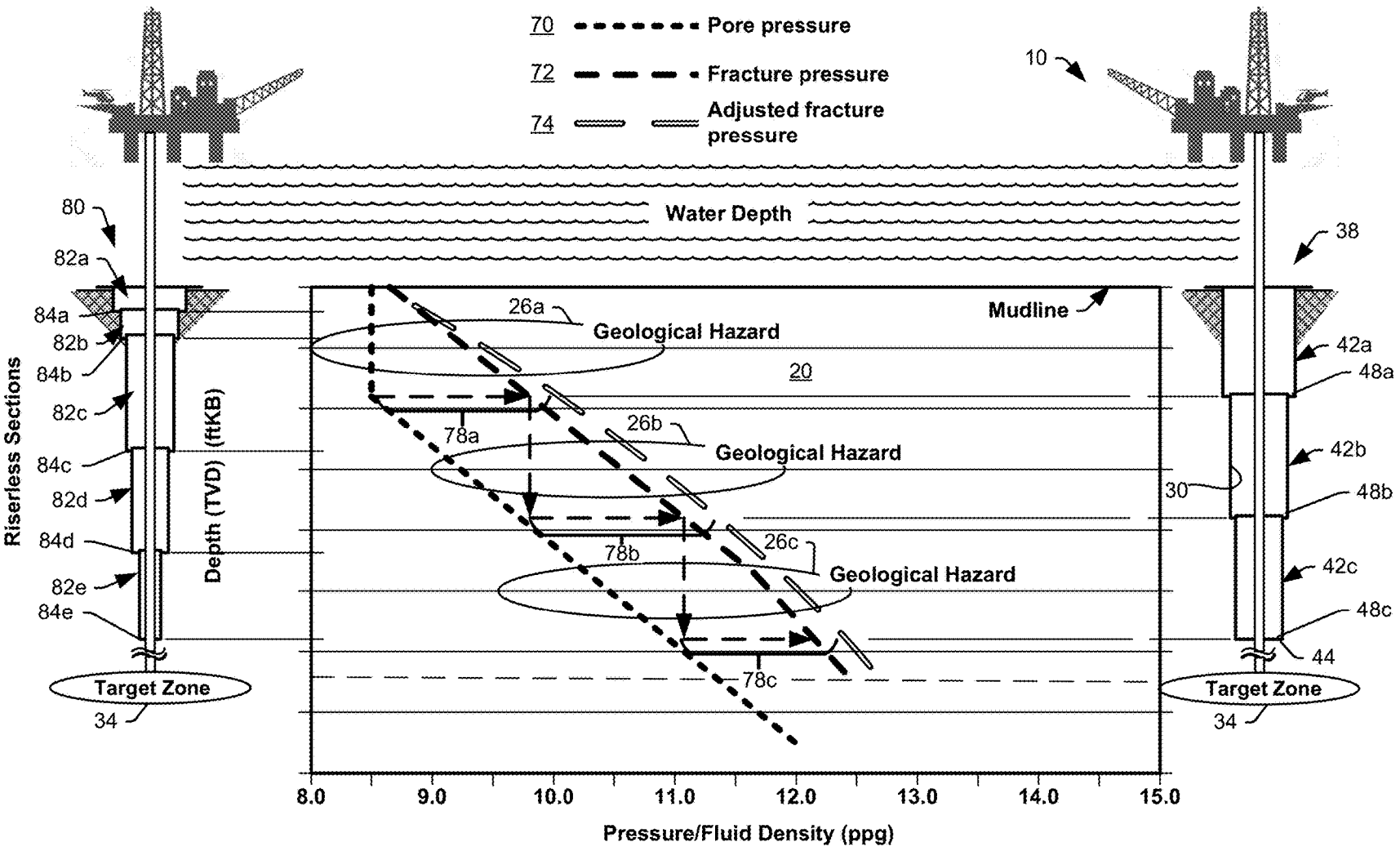
FIG. 2 is a graph of true vertical depth versus pressure illustrating example casing seat placement and casings relative to true vertical depth for an example according to current practice as a comparison to example casing seat placement and casings, according to embodiments of the disclosure.

FIG. 2 is a graph of true vertical depth versus pressure illustrating example casing seat placement and casings relative to true vertical depth and pore pressure and fracture pressure for a comparative example according to current practice as a comparison to example casing seat placement and casings, according to embodiments of the disclosure. FIG. 2 is similar to FIG. 1, except an example comparative well assembly 80 including casing seat placements consistent with current practice is provided for comparison with the well assembly 38 and casing seat placements according to embodiments of the disclosure, for example, as shown in FIG. 1.

As shown in FIG. 2, the comparative example well assembly 80 includes five casings 82*a*, 82*b*, 82*c*, 82*d*, and 82*e* to reach the depth of the target zone 34. By comparison, the example well assembly 38 according to embodiments of the disclosure includes only three casings 42*a*, 42*b*, and 42*c* to reach the depth of the target zone 34. As shown in FIG. 2, the depth of the first casing seat 84*a* may be limited by jetting-in the conductor, as is consistent with current practice. This corresponds to a true vertical depth of about 3,750 feet, significantly above the 4,400-foot true vertical depth of the first casing seat 48*a*, according to embodiments of the disclosure. The depth of the second casing seat 84*b* of the comparison well assembly 80 is selected to be above the range of the first geological hazard 26*a*. This corresponds to a true vertical depth of about 3,900 feet, significantly below the 5,400-foot true vertical depth of the second casing seat 48*b*, according to embodiments of the disclosure. According to current practice, as schematically depicted in FIG. 2, the depth of the third casing seat 84*c* of the comparative well assembly 80 is selected to be above the second geological hazard 26*b*, as is consistent with current practice. This corresponds to a true vertical depth of about 4,750 feet, significantly above the 6,400-foot true vertical depth of the third casing seat 48*c*, according to embodiments of the disclosure. The example well assembly 38 consistent with embodiments of the disclosure has reached the depth of the target zone 34 by the depth of the terminal end 44 of third casing 42*c* and the third casing seat 48*c*. In contrast, the comparative well assembly 80 uses two more casings 82*d* and 82*e* to reach the depth of the target zone 34.

Figure 3:
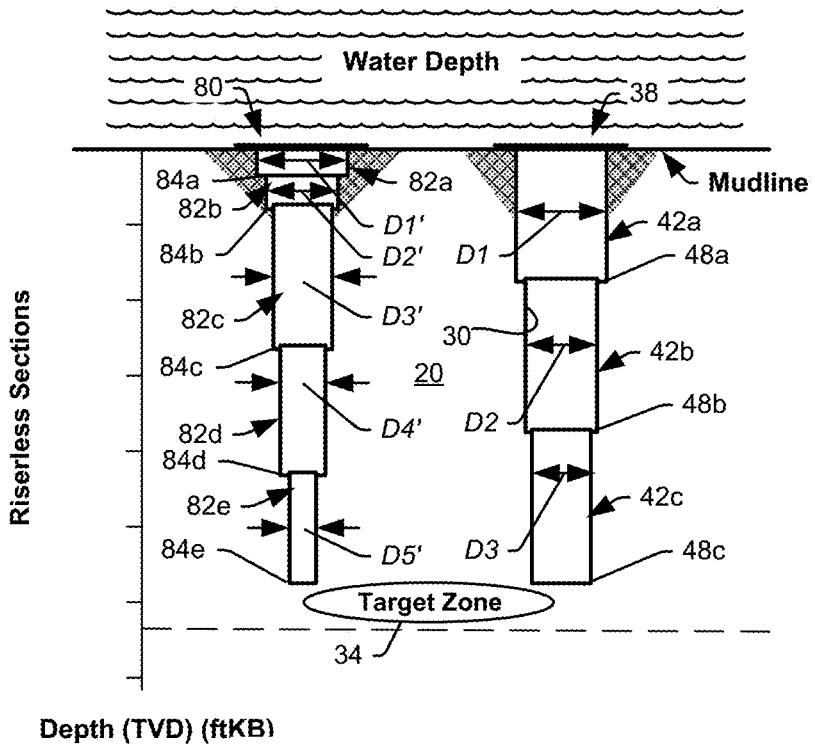
FIG. 3 is a schematic illustration showing a comparison of casing seat placement and casing diameter for an example according to current practice as compared to an example casing seat placement and casing diameter, according to embodiments of the disclosure.

FIG. 3 is a schematic illustration showing a comparison of casing seat placement and casing diameters for a comparative example according to current practice as compared to an example casing seat placement and casing diameters consistent with the embodiments shown in FIGS. 1 and 2, according to embodiments of the disclosure. More specifically, FIG. 3 shows an example comparative well assembly 80 including casing seat placements consistent with current practice, which is provided for comparison with the well assembly 38 and casing seat placements according to embodiments of the disclosure, for example, as shown in FIG. 1. This indicates a potential selection of hole section/casing strings in riserless sections, which may allow deepening of the first riserless casing section.

As shown in FIG. 3, and at least similar to FIG. 2, the comparative example well assembly 80 includes five casings 82*a*, 82*b*, 82*c*, 82*d*, and 82*e* to reach the depth of the target zone 34 at about 6,500 feet true vertical depth. As schematically depicted, the casings 82*a* through 82*e* have corresponding diameters of D1', D2', D3', D4', and D5', with the diameters narrowing as the casings 82*a* through 82*e* approach the depth of the target zone 34. By comparison, the example well assembly 38 according to embodiments of the disclosure includes only three casings 42*a*, 42*b*, and 42*c* to reach the depth of the target zone 34. The casings 42*a*, 42*b*, and 42*c* have corresponding diameters of D1, D2, and D3, also with the diameters narrowing as the casings 42*a* through 42*c* approach the depth of the target zone 34. However, as shown in FIG. 3, in the example well assembly 38 consistent with embodiments of the disclosure, the diameter D3 of the third casing 42*c* is much wider as compared to the diameter D5' of the fifth casing 82*e* of the comparative example, which is required to reach the depth of the target zone 34. Thus, the effect of the comparative well assembly 80 requiring five casings 82*a* through 82*e* to reach the depth of the target zone 34 is that the diameters of the deepest casings 82*d* and 82*e* are significantly smaller than the diameter of the third casing 42*c* of the example well assembly 38 according to embodiments of the disclosure. As a result, the relatively increased number of casings necessary to reach the intended depth of the wellbore 30 may result in reducing the cross-sectional area of the deepest casings because each deeper casing necessarily has a smaller diameter than the casing(s) located immediately above it. This results in "wasting" casing diameters. As the casing diameters decrease, it may become more difficult to achieve well objectives and to produce the hydrocarbons from target zone 34, potentially limiting the value of the well. As shown in FIG. 3, for example, in some embodiments, the relative reduction in the number of casings required to reach the depth of the target zone 34 may result in enhancing production of the target zone 34, potentially obtaining a greater proportion of the potential value of the well and decreasing the probability of wellbore pressure exceeding the fracture pressures.

Figure 4A:
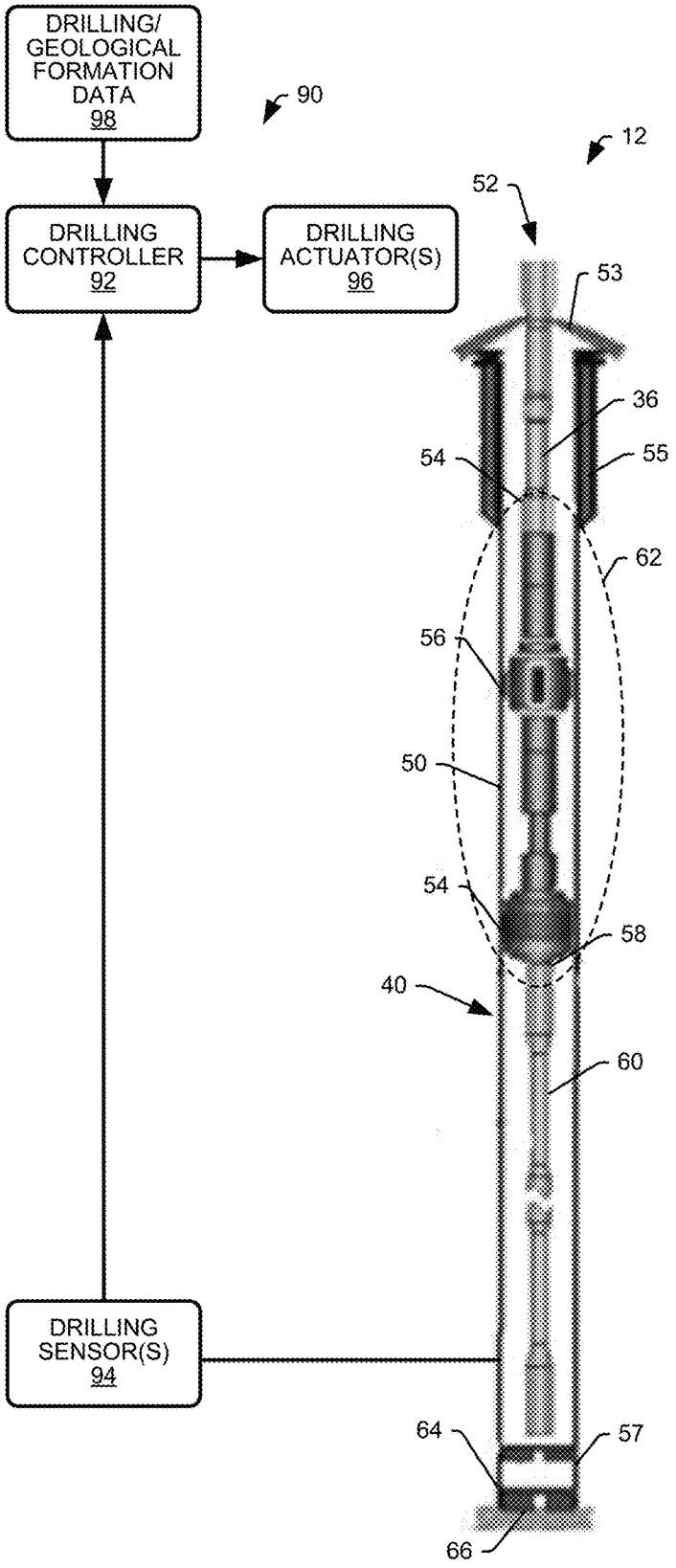
FIG. 4A is a schematic side view of an example subsea well casing drilling assembly, according to embodiments of the disclosure.
Figure 4B:
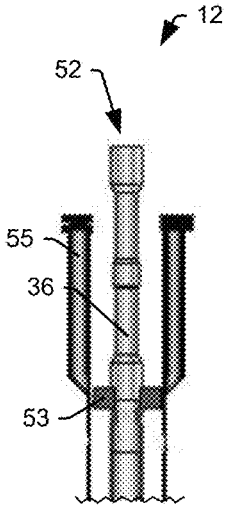
FIG. 4B is a schematic partial side view of an example subsea well casing drilling assembly including an example debris barrier positioned near the top, or below, a low pressure wellhead housing, according to embodiments of the disclosure.
Figure 5A:
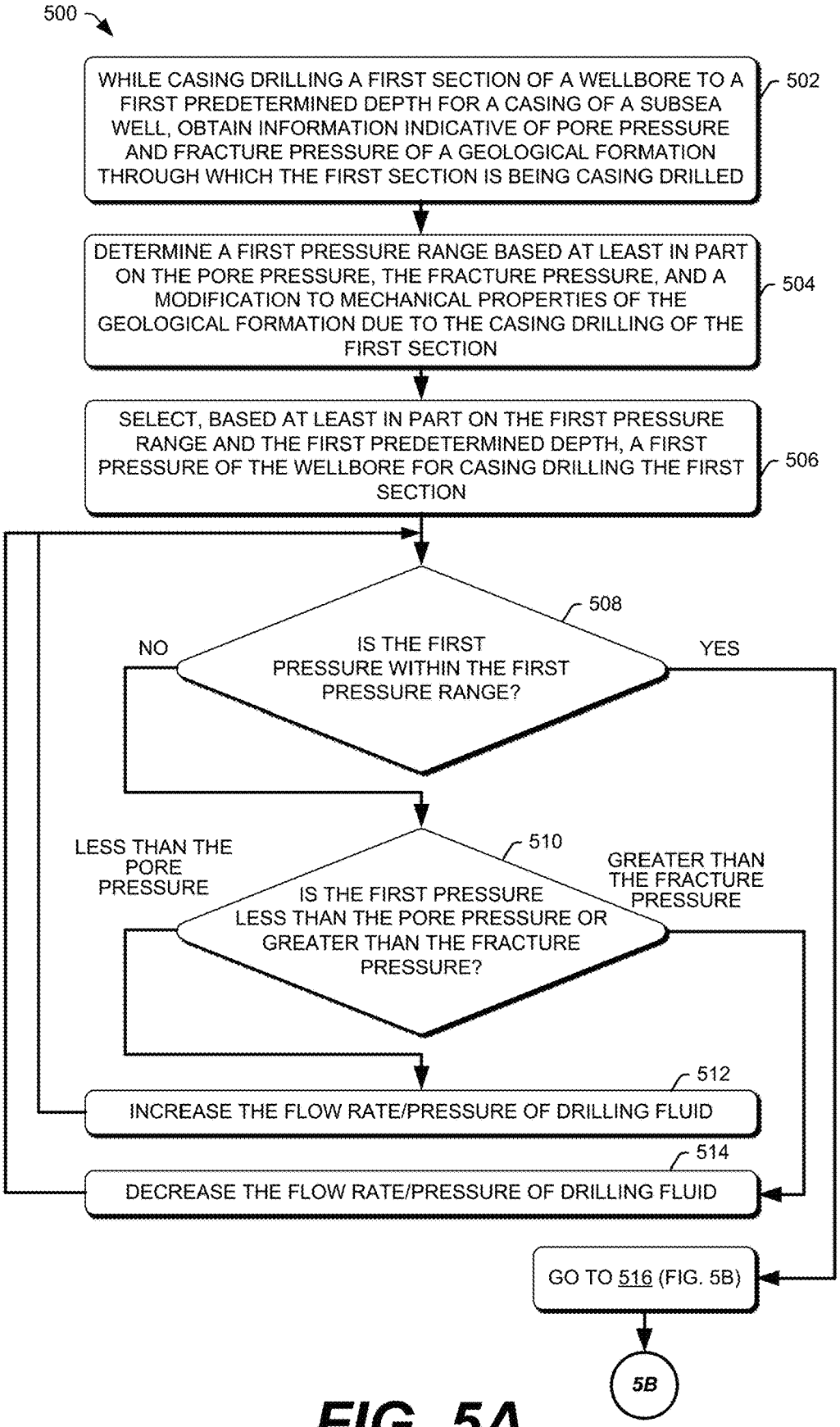
FIG. 5A is a block diagram of an example method for casing drilling a subsea well, according to embodiments of the disclosure.
Figure 5B:
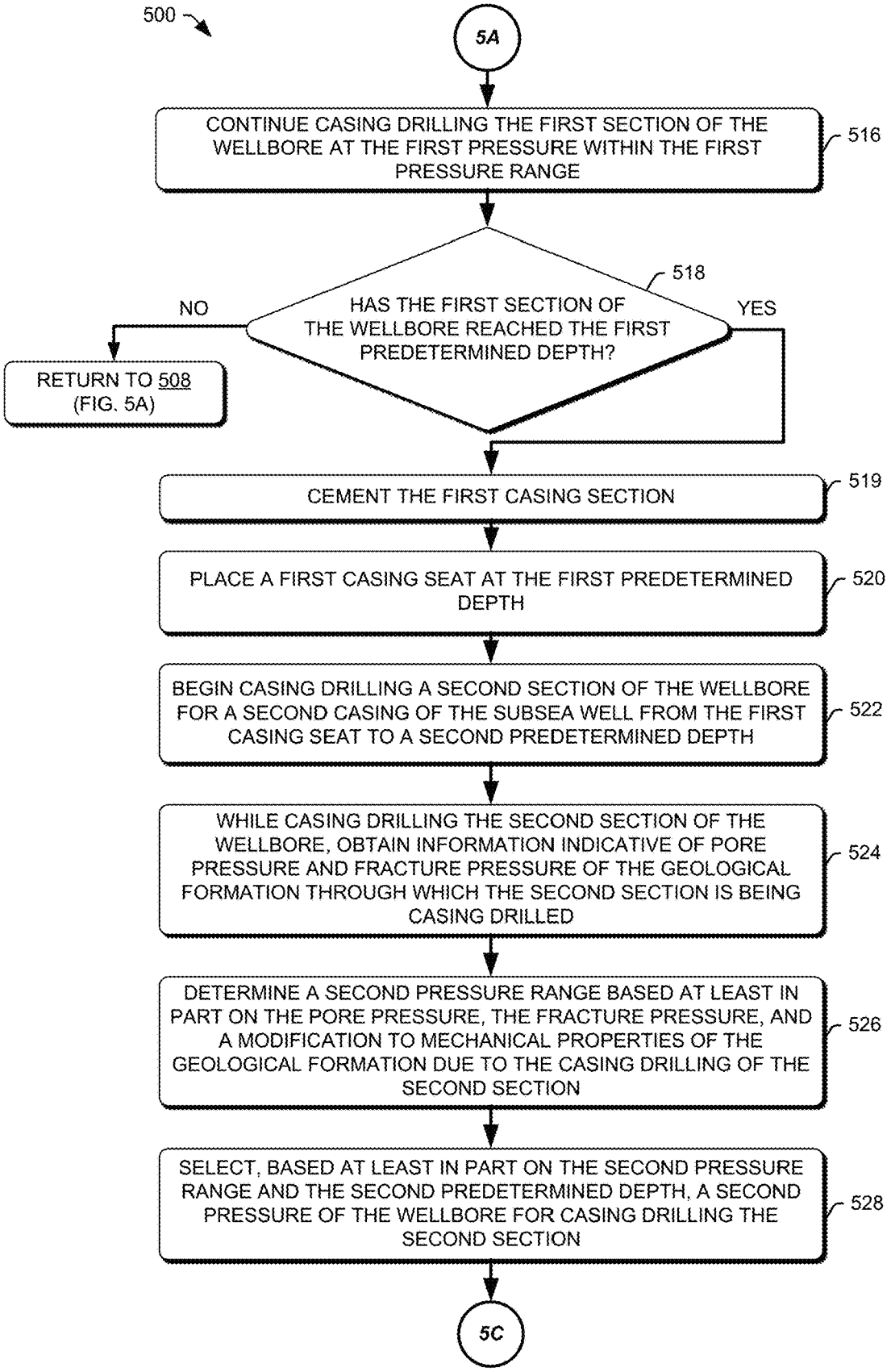
FIG. 5B is a continuation of the block diagram shown in FIG. 5A, according to embodiments of the disclosure.
Figure 5C:
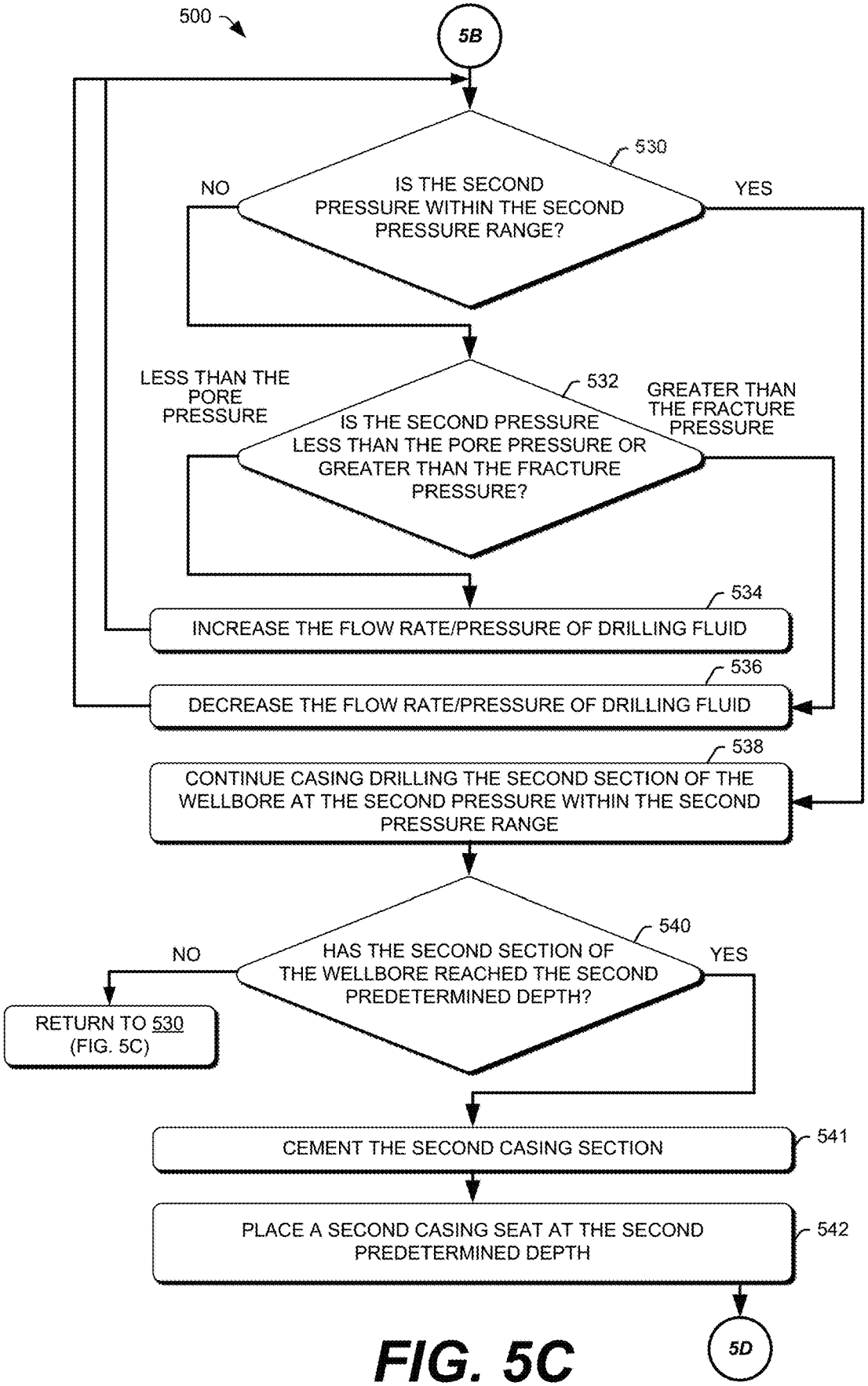
FIG. 5C is a continuation of the block diagram shown in FIG. 5A and FIG. 5B, according to embodiments of the disclosure.
Figure 5D:
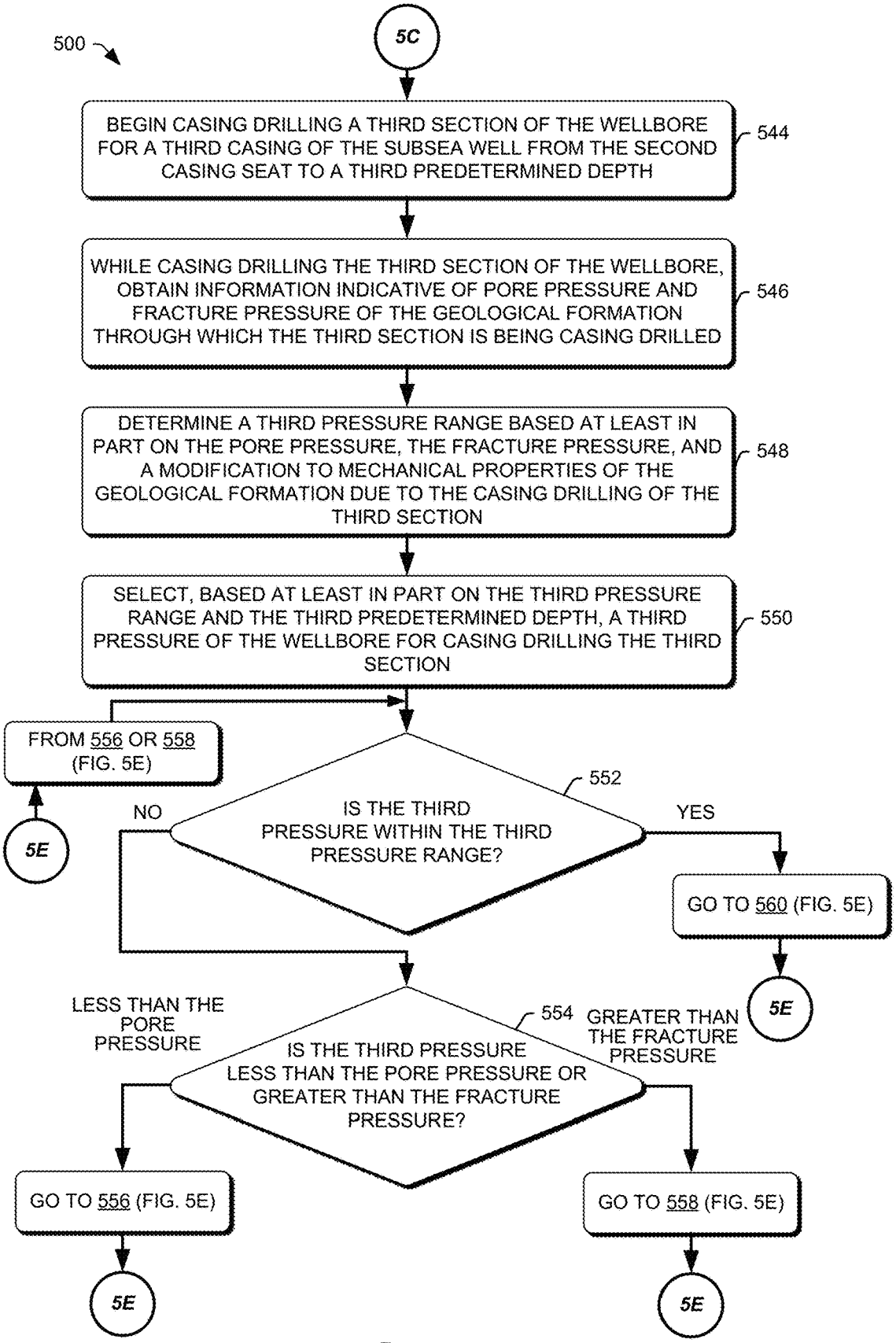
FIG. 5D is a continuation of the block diagram shown in FIG. 5A, FIG. 5B, and FIG. 5C, according to embodiments of the disclosure.
Figure 5E:
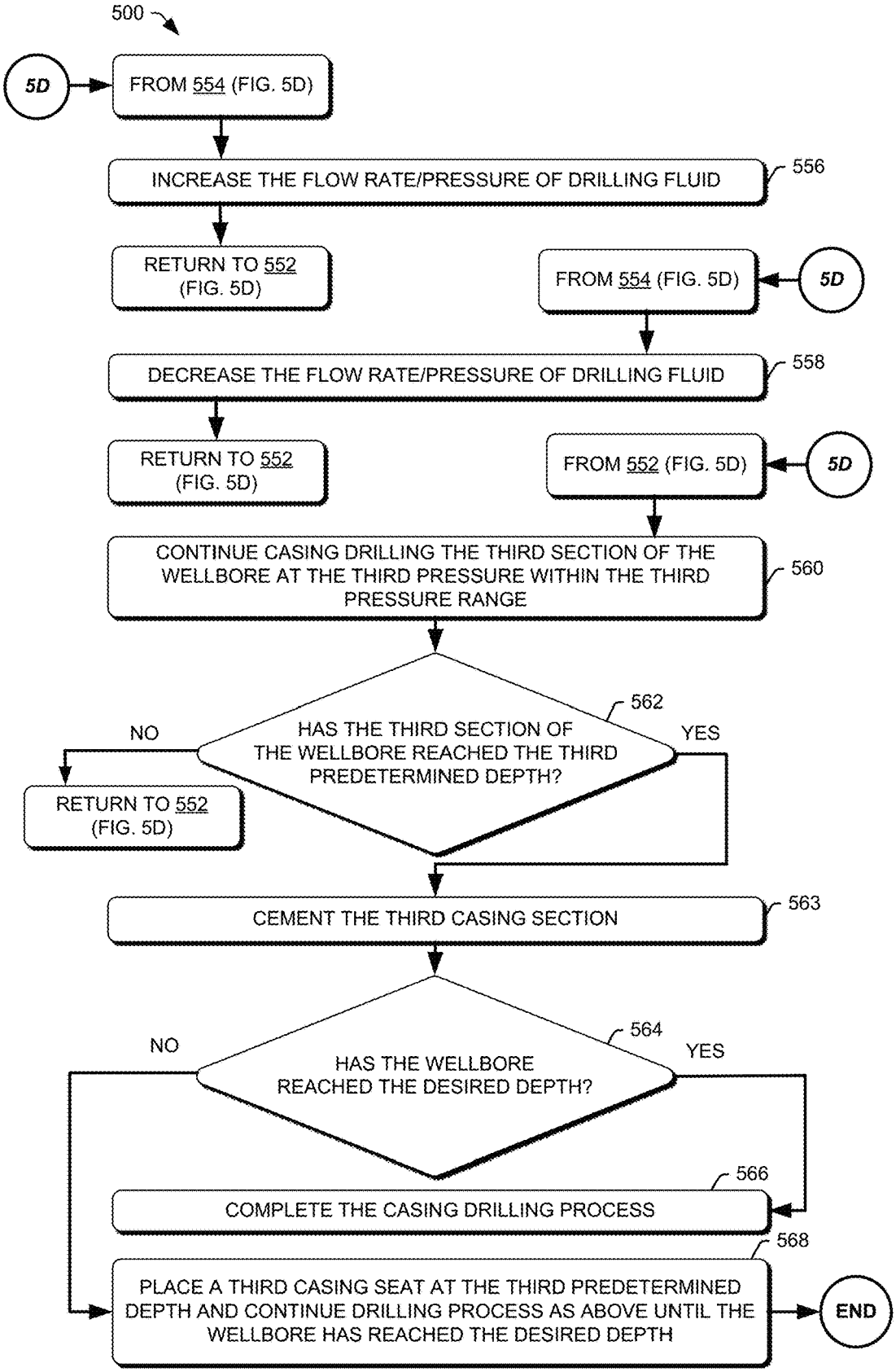
FIG. 5E is a continuation of the block diagram shown in FIG. 5A, FIG. 5B, FIG. 5C, and FIG. 5D, according to embodiments of the disclosure.

FIG. 4A is a schematic side view of an example subsea well casing drilling assembly 12 according to embodiments of the disclosure. As shown in FIG. 4A, in some embodiments, the subsea well casing drilling assembly 12 may include a casing string 40 including a tubular wall to provide a barrier between a flow of drilling fluids down the drill pipe 36 and 60 and up the outside of casing 40, isolating the geological formation 20 shown in FIG. 1 and a wellbore 30 (see e.g., FIGS. 1-3) traversing a portion of the subsea geological formation. The casing drilling assembly 12 further may include a drive assembly 52 received in the casing string 40. In some embodiments, the drive assembly 52 may include a driven interface 54 configured to be connected to a running string 36 (see e.g., FIG. 1) supported by a drilling rig 14 and rotated by the drilling rig 14, for example, by rotating equipment supported by the drilling rig 14, as will be understood by those skilled in the art. In some embodiments, the drive assembly 52 further may include a casing interface 56 connected to the interior surface of the casing string 40 and configured to transfer rotation between the drive assembly 52 and the casing string 40. The drive assembly 52 also may include, in some embodiments, a cementing string interface 58 configured to be connected to a cementing string 60, and a tubular drive body 62 extending at least partially between the driven interface 54 and the cementing string interface 58 and being configured to receive drilling fluids therethrough. The casing drilling assembly 12 further may include a cementing string 60 connected to the cementing string interface 58 and positioned to provide fluid flow between the drive assembly 52 and a terminal end 64 of the casing string 40. In some embodiments, the casing drilling assembly 12 still further may include a casing bit 66 connected to the terminal end 64 of the casing string 40. The casing bit 66 may be positioned to rotate with the casing string 40 and drill into the geological formation 20 to form the wellbore 30 traversing one or more sections of the geological formation 20. In some embodiments, the casing drilling assembly 12 further may include a debris barrier 53 configured to prevent drilling debris from entering the drive assembly 52. In some embodiments, a low pressure housing 55 (e.g., a low-pressure wellhead housing assembly) may be provided adjacent the debris barrier 53. For example, as shown ion FIG. 4A, the debris barrier 53 may be connected to an end of the low pressure housing 55 closest to the drilling rig 14 (see, e.g., FIG. 1). As shown in FIG. 4B, in some embodiments, the debris barrier 53 may be positioned above or below, for example, the low pressure housing 55. For example, the debris barrier 53 may be connected to the casing string 40 at an end of the low pressure housing 55 remote from the drilling rig 14. As shown in FIG. 4A, some embodiments may include centralizers on the cementing string, a cementing float and shoe track 57, for example, adjacent the casing bit 66. One or more sections of the casing string 40 may be left in place upon completion of the drilling, for example, as described previously herein, and as will be understood by those skilled in the art.

As shown in FIG. 4A, in some embodiments, the casing drilling assembly 12 may include a casing drilling control assembly 90 including a drilling controller 92 configured to at least partially control operation of the casing drilling assembly 12. For example, the casing drilling assembly 12 may include one or more drilling sensor(s) 94 connected to or otherwise associated with the casing drilling assembly 12 and configured to generate one or more signals indicative of conditions and/or parameters associated with the casing drilling operation, such as, for example, one or more pressure sensors configured to generate signals indicative of pressure associated with the drilling fluid and/or the geological formation 20, one or more flow meters configured to generate signals indicative of the flow rate of the flow of drilling fluid, one or more temperature sensors configured to generate signals indicative of temperature associated with the drilling fluid, the casing 42, the casing bit 66, and/or the geological formation 20, and/or one or more depth sensors configured to generate one or more signals indicative of the well depth. In some embodiments, the one or more depth sensors may include, or be supplemented by, one or more of the pressure sensors, flow meters, or temperature sensors. The one or more drilling sensor(s) 94 may be in communication with the drilling controller 92, for example, via hard-wired and/or wireless communications protocols, and the drilling controller 92 may use control logic, such as the control logic described herein, in the form of computer software and/or hardware programs to make control decisions associated with controlling operation of the casing drilling assembly 12 and/or equipment on the drilling rig 14.

For example, as shown in FIG. 4A, the casing drilling assembly 12 may include one or more drilling actuators 96 of the casing drilling assembly 12 and/or associated with equipment on the drilling rig 14 (e.g., rotating equipment, such as one or more motors, and/or one or more fluid pumps), and the drilling controller 92 may communicate control signals based at least in part on the control decisions to the one or more drilling actuator(s) 96 to at least partially control the casing drilling operation, and the one or more drilling actuator(s) 96 may be operated according to the communicated control signals to operate the parts of the casing drilling assembly 12 and/or equipment on the drilling rig 14. In some embodiments, the drilling controller 92 also may be in communication with data stored in computer memory, and the data may include drilling and/or geological formation data 98, such as, for example, data related to previous casing drilling operations and/or data associated with the geological formation 20 (see, e.g., FIGS. 1-3), such as pore pressure data and/or fracture pressure or fracture gradient data associated with the geological formation 20. In some embodiments, the drilling controller 92 may be configured to access and/or use the drilling and/or geological formation data 98 when generating control decisions and/or communicating control signals to the drilling actuator(s) 96. In some examples, the drilling controller 92 may be supplemented or replaced by human operators at least partially manually controlling the casing drilling assembly 12 to meet desired performance criteria of the casing drilling operation.

In some embodiments, the drilling controller 92 may be in communication with one or more of the drilling rig 14, the drive assembly 52, or the one or more drilling sensor(s) 94. The drilling controller 92 may be configured to receive one or more drilling signals from the one or more drilling sensor(s) 94, and determine, based at least in part on the one or more drilling signals, information indicative of pore pressure and fracture pressure of the geological formation 20 through which a section of the wellbore 30 for one or more of the casings 42 of the subsea well is being casing drilled to a predetermined depth. The drilling controller 92 also may be configured to determine a pressure range based at least in part on the pore pressure 70, the fracture pressure 72, and a modification to mechanical properties of the geological formation 20 due to the casing drilling of the section, and select, based at least in part on the pressure range and the predetermined depth, a pressure of the wellbore 30 for casing drilling the section. The drilling controller 92 further may be configured to at least partially control the rotating equipment on the drilling rig 14 and/or the drive assembly 52 to casing drill the section of the wellbore 30 to the predetermined depth, for example, as described previously herein.

In some embodiments, the drilling controller 92 may be configured to determine the pressure range by estimating a post-drilling fracture pressure of the section following casing drilling and adjusting the fracture pressure based at least in part on the post-drilling fracture pressure. The drilling controller 92 may be configured to determine the predetermined depth (e.g., of a first casing seat) based at least in part on a depth at which the pore pressure 70 exceeds a gradient of salt water.

In some embodiments, referring to FIGS. 1 and 4A, the predetermined depth is the first predetermined depth 76*a*, the casing is the first casing 42*a*, and the section is the first section 46*a*. In some such embodiments, the drilling controller 92 may be configured to at least partially control placement of the first casing seat 48*a* at the first predetermined depth 76*a*. The drilling controller 92 may be configured to receive one or more second drilling signals from the one or more drilling sensor(s) 94, and determine, based at least in part on the one or more second drilling signal(s) 94, information indicative of a second pore pressure and a second fracture pressure of the geological formation 20 through which the second section 46*b* of the wellbore 30 for the second casing 42*b* of the subsea well is being casing drilled to the second predetermined depth 76*b*. The drilling controller 92 also may be configured to determine a second pressure range 78*b* based at least in part on the second pore pressure, the second fracture gradient (e.g., a second fracture pressure), and a second modification to mechanical properties of the geological formation 20 due to the casing drilling of the second section 46*b*. Based at least in part on the second pressure range 78*b* and the second predetermined depth 76*b*, the drilling controller 92 further may be configured to select a second pressure of the wellbore 30 for casing drilling the second section 46*b*, and at least partially control the rotating equipment (e.g., one or more motors) and/or the drive assembly 52 to casing drill the second section 46*b* of the wellbore 30 to the second predetermined depth 76*b*. In some embodiments, the drilling controller 92 may be configured to determine a first fracture gradient (e.g., a first fracture pressure) at a first true vertical depth of the first casing seat 48*a*, determine a second true vertical depth at which the second pore pressure approaches or equals the first fracture gradient, and determine the second predetermined depth 76*b* based at least in part on the second true vertical depth.

Referring to FIGS. 1 and 4A, in some embodiments, the drilling controller 92 may be configured to at least partially control placement of a second casing seat 48*b* at the second predetermined depth 76*b*. The drilling controller 92 also may be configured to receive one or more third drilling signals from the drilling sensor(s) 94, and determine, based at least in part on the third drilling signals, information indicative of a third pore pressure and a third fracture gradient (e.g., a third fracture pressure) of the geological formation 20 through which a third section 46*c* of the wellbore 30 for a third casing 42*c* of the subsea well is being casing drilled to a third predetermined depth 76*c*. The drilling controller 92 further may be configured to determine a third pressure range 78*c* based at least in part on the third pore pressure, the third fracture gradient (e.g., a third fracture pressure), and a third modification to mechanical properties of the geological formation due to the casing drilling of the third section 46*c* of the wellbore 30. In some embodiments, the drilling controller 92 also may be configured to select, based at least in part on the third pressure range 78*c* and the third predetermined depth 76*c*, a third gradient of the wellbore 30 for casing drilling the third section 46*c*, and at least partially control the rotating equipment of the drilling rig 14 (e.g., one or more motors) or the drive assembly 52 to casing drill the third section 46*c* of the wellbore 30.

In some embodiments, as shown in FIG. 4A, the drilling controller 92 may be configured to receive signals indicative of one or more of drilling information or geological formation information from a remote source (e.g., from drilling and/or geological formation data 98 stored in a database), and at least partially control the rotating equipment and/or the drive assembly 52 to casing drill a section of the wellbore 30. In some embodiments, the drilling controller 92 may be configured to estimate a post-drilling fracture pressure of a section of the wellbore 30 following the casing drilling, adjust the fracture pressure based at least in part on the post-drilling fracture pressure, and determine the associated pressure range based at least in part on the post-drilling fracture pressure. In some embodiments, the drilling controller 92 may be further configured to at least partially control, based at least in part on the one or more of the drilling signals, flow of drilling fluid through the cementing string 60.

Figure 6:
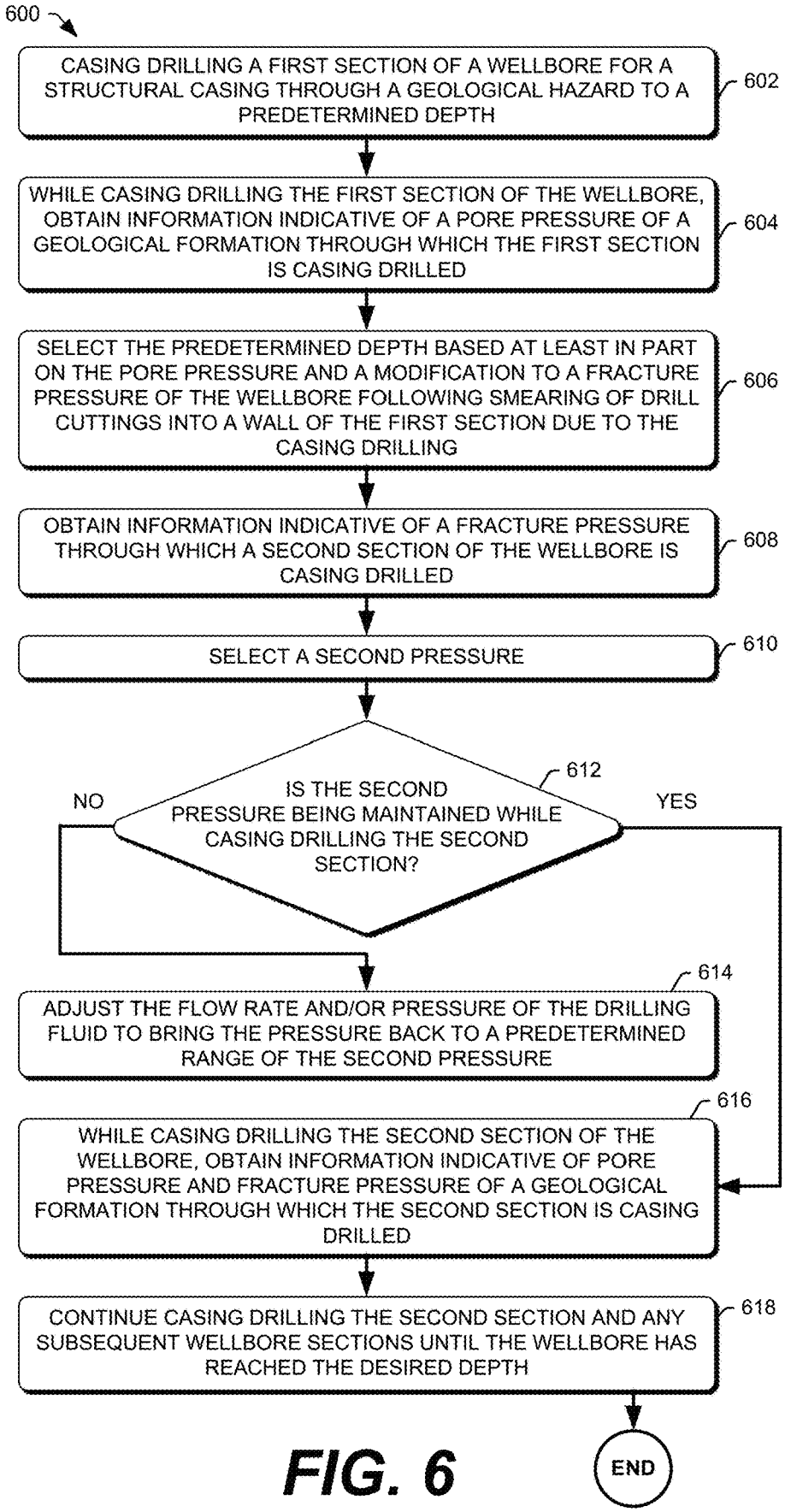
FIG. 6 is a block diagram of another example method for casing drilling a subsea well, according to embodiments of the disclosure.
Figure 7A:
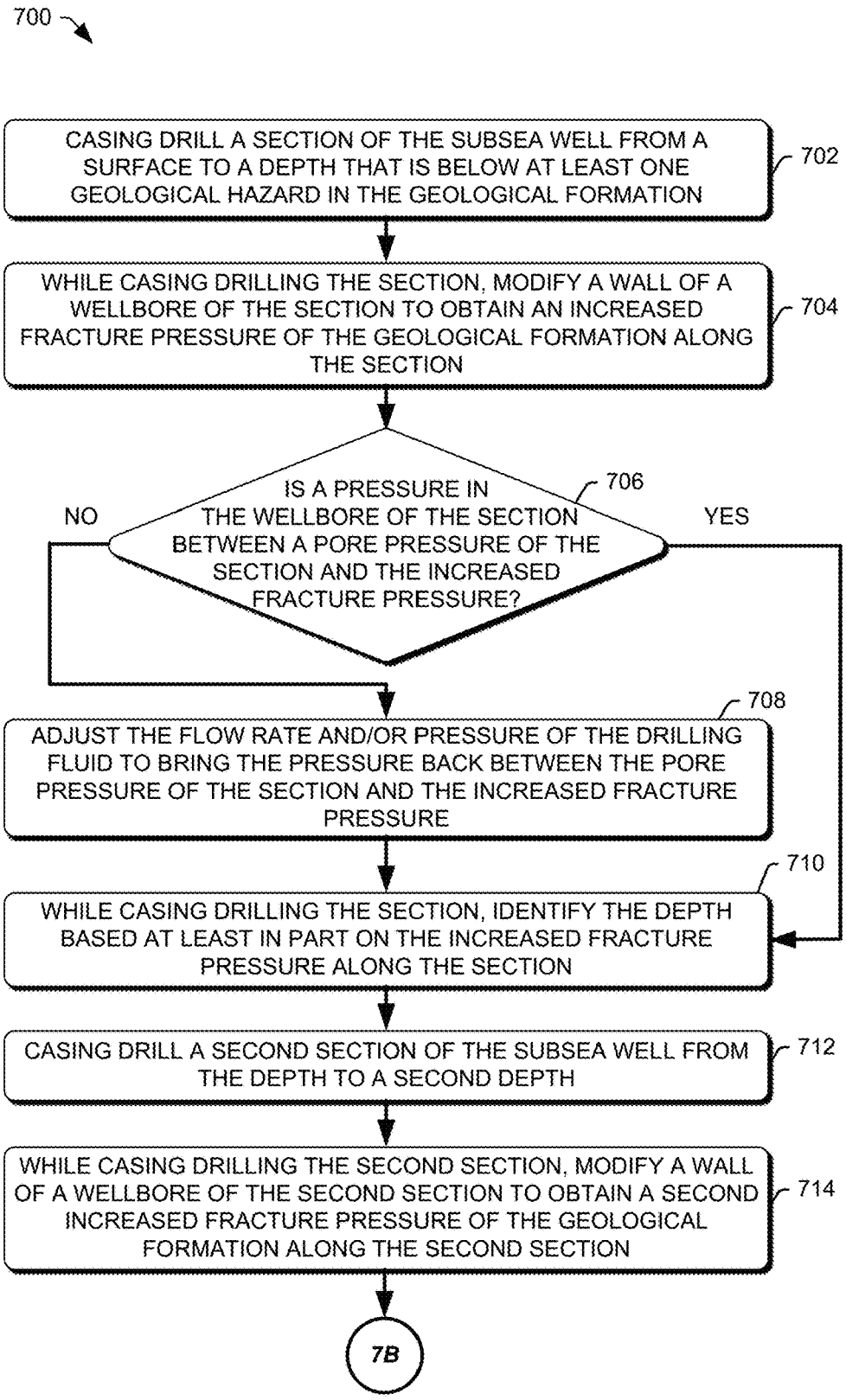
FIG. 7A is a block diagram of an example method for casing drilling a subsea well in a geological formation, according to embodiments of the disclosure.
Figure 7B:
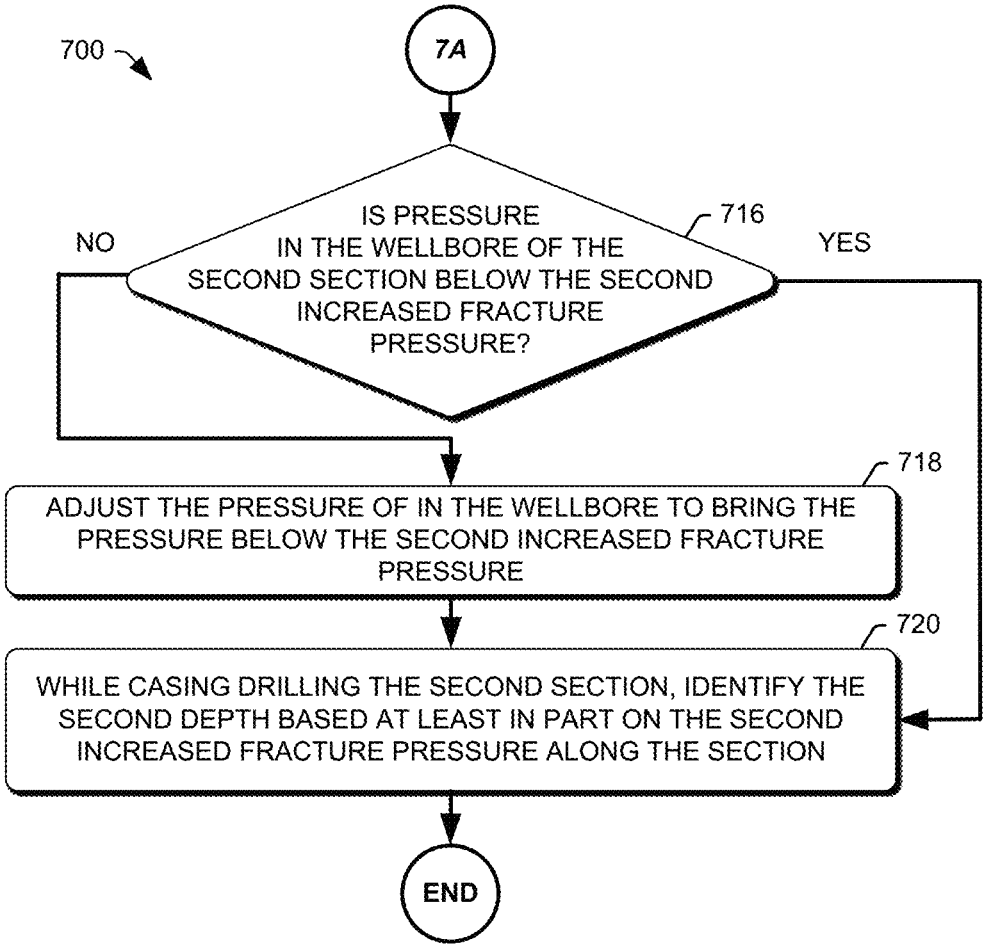
FIG. 7B is a continuation of the block diagram shown in FIG. 7A, according to embodiments of the disclosure.
Figure 8:
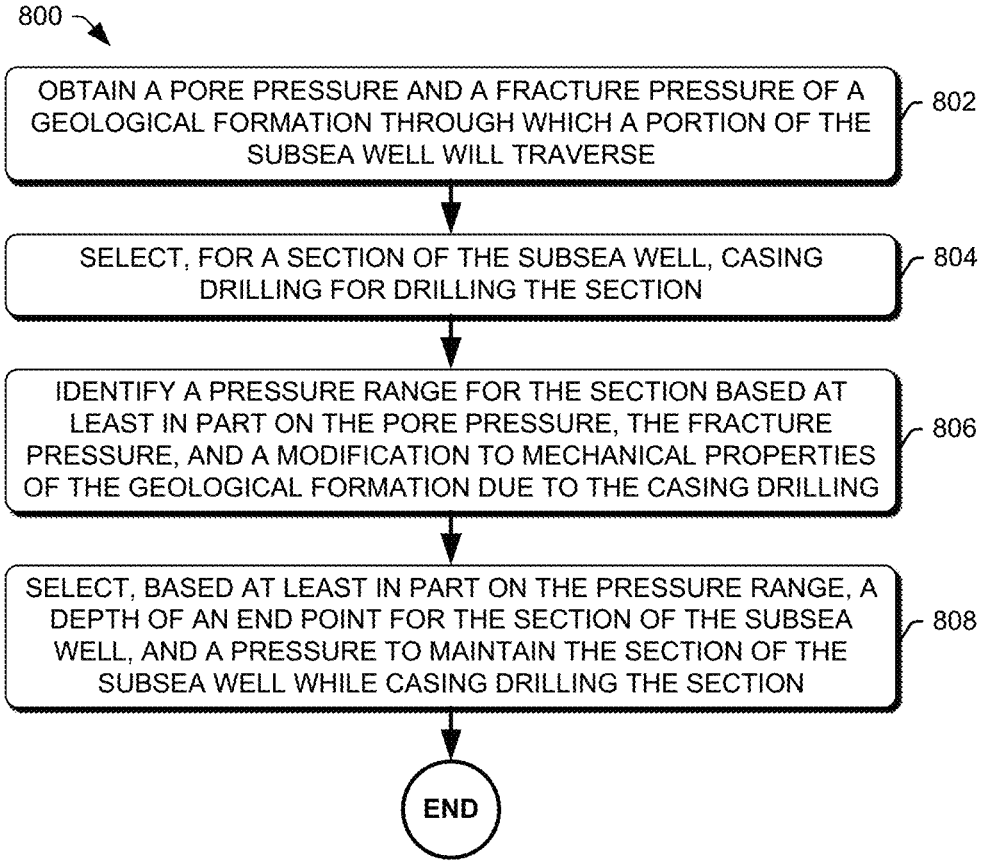
FIG. 8 is a block diagram of an example method for planning casing drilling of a subsea well, according to embodiments of the disclosure.

FIGS. 5A, 5B, 5C, 5D, 5E, 6, 7A, 7B, and 8 are block diagrams of respective example methods 500, 600, 700, and 800, according to embodiments of the disclosure. FIG. 5A through FIG. 5E are a block diagram of an example method 500 for casing drilling a subsea well (e.g., riserless sections of a subsea well), according to embodiments of the disclosure. FIG. 6 is a block diagram of another example method 600 for casing drilling a subsea well (e.g., riserless sections of a subsea well), according to embodiments of the disclosure. FIG. 7A and FIG. 7B are a block diagram of an example method 700 for casing drilling a subsea well (e.g., riserless sections of a subsea well) in a geological formation, according to embodiments of the disclosure. FIG. 8 is a block diagram of an example method 800 for planning casing drilling of a subsea well (e.g., riserless sections of a subsea well), according to embodiments of the disclosure. The example methods 500, 600, 700, and 800 are illustrated as collections of blocks in a logical flow graph, which represent a sequence of operations. In some embodiments, at least some portions of the methods 500, 600, 700, and 800 may be combined into, for example, a combined and/or coordinated method, which may occur at least partially concurrently and/or substantially simultaneously. In the context of software, where applicable, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described blocks can be combined in any order and/or in parallel to implement the methods.

FIG. 5A through FIG. 5E are a block diagram of an example method 500 for casing drilling a subsea well (e.g., riserless sections of a subsea well), according to embodiments of the disclosure. At 502 (see FIG. 5A), the example method 500 may include, while casing drilling a first section of a wellbore to a first predetermined depth for casing the riserless sections of a subsea well, obtaining information indicative of pore pressure and fracture pressure of a geological formation through which the first section is being casing drilled. For example, the casing drilling assembly may include one or more drilling sensors configured to generate signals indicative of pressure, temperature, flow rate, bore depth (e.g., well depth), and/or lithology associated with the casing drilling operation, which may be indicative of one or more of the pore pressure or the fracture pressure. In some embodiments, a drilling controller associated with the casing drilling assembly may access and/or be in communication with a database including drilling and/or geological formation information, which may be used supplement or take the place of one or more of the sensor signals. The predetermined depth may be at least in part based on a relationship at which the pore pressure exceeds a gradient of salt water.

In some embodiments, casing drilling the riserless section for the casing of the subsea well to the predetermined depth may include casing drilling through a geological hazard, for example, as described previously herein. In some embodiments, this may include, while casing drilling the first section of the wellbore, obtaining information indicative of a pore pressure of a geological formation through which the first section is casing drilled, and selecting the predetermined depth based at least in part on the pore pressure, a pressure maintained in the first section while casing drilling the first section, and a modification to the fracture pressure following smearing of drill cuttings into a wall of the first section due to the casing drilling. In some embodiments, the casing drilling may be performed at least partially by the subsea casing drilling assembly described herein. The casing may include a structural casing positioned to axially support a wellhead, and/or the casing may be a riserless casing. The subsea well may be a deepwater or ultra-deepwater subsea well. In some embodiments, casing drilling the riserless section may include increasing a fracture pressure of the section via smearing of drill cuttings into a wall of the wellbore. In some embodiments, the example method 500 may include determining one or more of the predetermined depth, the pore pressure, or the fracture pressure associated with the section prior to and/or during casing drilling the section.

At 504, the example method 500 may include determining a first pressure range based at least in part on the pore pressure, the fracture pressure, and a modification to mechanical properties of the geological formation due to the casing drilling of the first section. For example, the modification to the mechanical properties of the geological formation may result from smearing of the drill cuttings into a wall of the wellbore, which in some instances, may increase the pore pressure and/or the fracture pressure. In some embodiments, determining the pressure range may include estimating a post-drilling fracture pressure of the section following the casing drilling and adjusting the fracture pressure based at least in part on the post-drilling fracture pressure, for example, as described previously herein. In some embodiments, one or more of the pore pressures and/or one or more of the fracture pressures may be modified based at least in part on the modification of the mechanical properties of the geological formation due to the casing drilling of the section, for example, caused by the smearing of the drill cuttings into the wall of the wellbore, for example, as described previously herein.

The example method 500, at 506, may include selecting, based at least in part on the first pressure range and the first predetermined depth, a first pressure of the wellbore for casing drilling the first section, for example, as explained herein.

At 508, the example method 500 may further include determining whether the first pressure is within the first pressure range, for example, as described previously herein.

If not, the example method 500, at 510, further may include determining whether the first pressure is less than the pore pressure or greater than the fracture pressure. If the first pressure is less than the pore pressure, at 512, the example method 500 may include increasing the flow rate and/or the pressure of the drilling fluid. If the first pressure is greater than the fracture pressure, the example method 500, at 514, may include decreasing the flow rate and/or the pressure of the drilling fluid.

After 512 or 514, the example method 500 may further include returning to 508 to repeat determining whether the first pressure is within the first pressure range. Once the first pressure is within the first pressure range, the example method 500 may advance to 516 (FIG. 5B), and the example method 500 may include continuing casing drilling the first section of the wellbore at the first pressure within the first pressure range.

At 518, the example method 500 may include determining whether the first section of the wellbore has reached the first predetermined depth. If not, the example method 500 may include returning to 508 (FIG. 5A) to repeat determining whether the first pressure is within the first pressure range, and continue the casing drilling process until the first section of the wellbore has reached the first predetermined depth.

If, at 518, the first section of the wellbore has reached the first predetermined depth, at 519, the example method 500 may further include cementing the first casing section (e.g., a structural casing section), for example, to hold the first casing section in place and/or to prevent fluid migration between subsurface formations.

At 520, the example method 500 may further include placing a first casing seat at the first predetermined depth. In some embodiments, after reaching the first predetermined depth, the example method 500 may include determining whether the wellbore has reached the desired depth. If so, the casing drilling process may be terminated. If not, the example method 500 may continue to the next step.

At 522, the example method 500 may further include beginning casing drilling a second section of the wellbore for a second riserless casing of the subsea well from the first casing seat to a second predetermined depth. In some embodiments, determining the second predetermined depth may include determining a first fracture gradient (or pressure) at a first true vertical depth of the first casing seat, determining a second true vertical depth at which the pore pressure approaches or equals the first fracture gradient, and determining the second predetermined depth based at least in part on the second true vertical depth.

The example method 500, at 524, may further include, while casing drilling the second section of the wellbore, obtaining information indicative of pore pressure and fracture pressure of the geological formation through which the second section is being casing drilled, for example, in a manner at least similar to 502 above.

At 526, the example method 500 also may include determining a second pressure range based at least in part on the pore pressure, the fracture pressure, and a modification to mechanical properties of the geological formation due to the casing drilling of the second section, for example, as previously described herein.

The example method 500, at 528, may include selecting, based at least in part on the second pressure range and the second predetermined depth, a second pressure of the wellbore for casing drilling the second section, for example, as explained herein.

At 530 (FIG. 5C), the example method 500 may further include determining whether the second pressure is within the second pressure range, for example, as described previously herein.

If not, the example method 500, at 532, further may include determining whether the second pressure is less than the pore pressure or greater than the fracture pressure. If the second pressure is less than the pore pressure, at 534, the example method 500 may include increasing the flow rate and/or the pressure of the drilling fluid. If the second pressure is greater than the fracture pressure, the example method 500, at 536, may include decreasing the flow rate and/or the pressure of the drilling fluid.

After 534 or 536, the example method 500 may further include returning to 530 to repeat determining whether the second pressure is within the second pressure range. Once the second pressure is within the second pressure range, the example method 500 may advance to 538, and the example method 500 may include continuing casing drilling the second section of the wellbore at the second pressure within the second pressure range.

At 540, the example method 500 may include determining whether the second section of the wellbore has reached the second predetermined depth. If not, the example method 500 may include returning to 530 to repeat determining whether the second pressure is within the second pressure range, and continue the casing drilling process until the second section of the wellbore has reached the second predetermined depth.

If, at 540, the second section of the wellbore has reached the second predetermined depth, at 541, the example method 500 may further include cementing the second casing section, for example, to hold the second casing section in place and/or to prevent fluid migration between subsurface formations.

At 542, the example method 500 may further include placing a second casing seat at the second predetermined depth. In some embodiments, after reaching the second predetermined depth, the example method 500 may include determining whether the wellbore has reached the desired depth. If so, the casing drilling process may be terminated. If not, the example method 500 may continue to the next step.

At 544, the example method 500 may include beginning casing drilling a third riserless section of the wellbore for a third casing of the subsea well from the second casing seat to a third predetermined depth. For example, in some embodiments, determining the third predetermined depth may include determining a first fracture gradient (or pressure) at a first true vertical depth of the first casing seat, and determining a second true vertical depth at which a pore pressure approaches or equals the first fracture gradient. Determining the third predetermined depth also may include setting the second predetermined depth based at least in part on the second true vertical depth, and determining a second fracture gradient (or pressure) at the second true vertical depth of the second casing seat. Determining the third predetermined depth further may include determining a third true vertical depth at which a pore pressure approaches or equals the second fracture gradient, and determining the third predetermined depth based at least in part on the third true vertical depth.

The example method 500, at 546, may further include, while casing drilling the third riserless section of the wellbore, obtaining information indicative of pore pressure and fracture pressure of the geological formation through which the third section is being casing drilled, for example, in a manner at least similar to 502 above.

At 548, the example method 500 also may include determining a third pressure range based at least in part on the pore pressure, the fracture pressure, and a modification to mechanical properties of the geological formation due to the casing drilling of the third section, for example, as previously described herein.

The example method 500, at 550, may include selecting, based at least in part on the third pressure range and the third predetermined depth, a third pressure of the wellbore for casing drilling the third section, for example, as explained herein.

At 552, the example method 500 may further include determining whether the third pressure is within the third pressure range, for example, as described previously herein.

If not, the example method 500, at 554, further may include determining whether the third pressure is less than the pore pressure or greater than the fracture pressure. If the third pressure is less than the pore pressure, at 556 (FIG. 5E), the example method 500 may include increasing the flow rate and/or the pressure of the drilling fluid. If the third pressure is greater than the fracture pressure, the example method 500, at 558 (FIG. 5E), may include decreasing the flow rate and/or the pressure of the drilling fluid.

After 556 or 558, the example method 500 may further include returning to 552 to repeat determining whether the third pressure is within the third pressure range. Once the third pressure is within the third pressure range, the example method 500 may advance to 560, and the example method 500 may include continuing casing drilling the third section of the wellbore at the third pressure within the third pressure range.

At 562, the example method 500 may include determining whether the third section of the wellbore has reached the third predetermined depth. If not, the example method 500 may include returning to 552 (FIG. 5D) to repeat determining whether the third pressure is within the third pressure range, and continue the casing drilling process until the third section of the wellbore has reached the third predetermined depth.

If, at 562, the third section of the wellbore has reached the third predetermined depth, at 563, the example method 500 may further include cementing the third casing section, for example, to hold the third casing section in place and/or to prevent fluid migration between subsurface formations.

The example method 500, at 564, further may include determining whether the wellbore has reached the desired depth. If so, at 566, the example method 500 may complete or terminate the casing drilling process. If not, at 568, the example method 500 may include placing a third casing seat at the third predetermined depth and continuing the casing drilling process as outlined above until the wellbore has reached the desired depth. For example, in some embodiments, one or more of the steps of the example method 500 outlined above may be substantially repeated, for example, for drilling additional wellbore sections until an intended wellbore depth is reached.

FIG. 6 is a block diagram of another example method 600 for casing drilling a subsea well (e.g., riserless sections of a subsea well), according to embodiments of the disclosure. At 602, the example method 600 may include casing drilling a first section of a wellbore for a structural casing through a geological hazard to a predetermined depth, for example, as previously described herein. In some embodiments, this may include using the subsea casing drilling assembly according to embodiments described herein.

At 604, the example method 600 also may include, while casing drilling the first section of the wellbore, obtaining information indicative of a pore pressure of a geological formation through which the first section is casing drilled, for example, as described previously herein.

The example method 600, at 606, further may include selecting the predetermined depth based at least in part on the pore pressure and a modification to a fracture pressure of the wellbore following smearing of drill cuttings into a wall of the first section due to the casing drilling, for example, as previously described herein.

At 608, the example method 600 also may include obtaining information indicative of a fracture pressure through which a second section of the wellbore is casing drilled, for example, as described previously herein.

The example method 600, at 610, further may include selecting a second pressure based at least in part on the fracture pressure through which the second section of the wellbore is casing drilled and a modification to the fracture pressure following smearing of drill cuttings into a wall of the second section of the wellbore due to the casing drilling of the second section, for example, as described previously herein.

At 612, the example method 600 also may include determining whether the second pressure is being maintained within a predetermined range of the second pressure. If not, at 614, the example method 600 may include adjusting the flow rate and/or pressure of the drilling fluid to bring the pressure back to within the predetermined range of the second pressure. In some embodiments, the example method 600 may include maintaining the second pressure while casing drilling the second section of the wellbore.

If so, the example, method 600, at 616, may include, while casing drilling the second riserless section of the wellbore, obtaining information indicative of pore pressure and fracture pressure of a geological formation through which the second section is casing drilled, for example, as previously described herein. In some embodiments, one or more of the steps of the example method 600 outlined above may be substantially repeated, for example, for drilling additional casing sections until an intended wellbore depth is reached.

At 618, the example method 600 further may include continuing casing drilling of the second section of the wellbore and any subsequent wellbore sections until the wellbore has reached the desired depth, for example, in a manner at least similar to the manner described herein with respect to FIGS. 5A through 5E.

FIG. 7A and FIG. 7B are a block diagram of an example method 700 for casing drilling a subsea well (e.g., riserless sections of a subsea well) in a geological formation according to embodiments of the disclosure. At 702 (FIG. 7A), the example method may include casing drilling a section (e.g., a riserless section) of the subsea well from a surface to a depth that is below at least one geological hazard in the geological formation, for example, as described previously herein.

At 704, the example method 700 further may include, while casing drilling the section, modifying a wall of a wellbore of the section to obtain an increased fracture pressure of the geological formation along the section, for example, as described previously herein.

The example method 700, at 706 also may include, while casing drilling the section, determining whether a pressure in the wellbore of the section of the wellbore is between a pore pressure of the section and the increased fracture pressure. If not, at 708, the example method 700 further may include adjusting the flow rate and/or pressure of the drilling fluid to bring the pressure back between the pore pressure of the section and the increased fracture pressure.

If so, at 710, the example method 700 further may include, while casing drilling the section, identifying the depth based at least in part on the increased fracture pressure along the section, for example, as previously described herein.

In some embodiments, the section of the subsea well includes a first section (e.g., a first riserless section) of the subsea well, the increased fracture pressure includes a first increased fracture pressure, and the depth is a first depth. In some such embodiments, the example method 700, at 712, may further include casing drilling a second section (e.g., a second riserless section) of the subsea well from the first depth to a second depth, for example, as previously described herein.

At 714, the example method 700, also may include, while casing drilling the second section, modifying a wall of a wellbore of the second section to obtain a second increased fracture pressure of the geological formation along the second section, for example, as previously described herein.

The example method 700, at 716 (FIG. 7B), further may include, determining whether pressure in the wellbore of the second section is below the second increased fracture pressure while casing drilling the second section. If not, at 718, the example method 700 may include adjusting the pressure of in the wellbore in the second section to bring the pressure below the second increased fracture pressure. If so, the example method 700 may advance to 718.

At 718, the example method 700 also may include, while casing drilling the second section, identifying the second depth based at least in part on the second increased fracture pressure along the section, for example, as previously described herein. In some embodiments, one or more of the steps of the example method 700 outlined above may be substantially repeated, for example, for drilling additional casing sections until an intended wellbore depth is reached.

FIG. 8 is a block diagram of an example method 800 for planning casing drilling of a subsea well according to embodiments of the disclosure. At 802, the example method 800 may include obtaining a pore pressure and a fracture pressure of a geological formation through which a portion of the subsea well will traverse, for example, as described previously herein.

At 804, the example method 800 also may include selecting, for a section of the subsea well, casing drilling for drilling the section, for example, as described previously herein.

The example method 800, at 806, further may include identifying a pressure range for the section based at least in part on the pore pressure, the fracture pressure, and a modification to mechanical properties of the geological formation due to the casing drilling, for example, as previously described herein.

At 808, the example method 800 also may include selecting, based at least in part on the pressure range, a depth of an end point for the section of the subsea well, and a pressure to maintain the section of the subsea well while casing drilling the section, for example, as described previously herein. In some embodiments, one or more of the steps of the example method 800 outlined above may be substantially repeated, for example, for drilling additional casing sections until an intended wellbore depth is reached.

It should be appreciated that at least some subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

Figure 9:
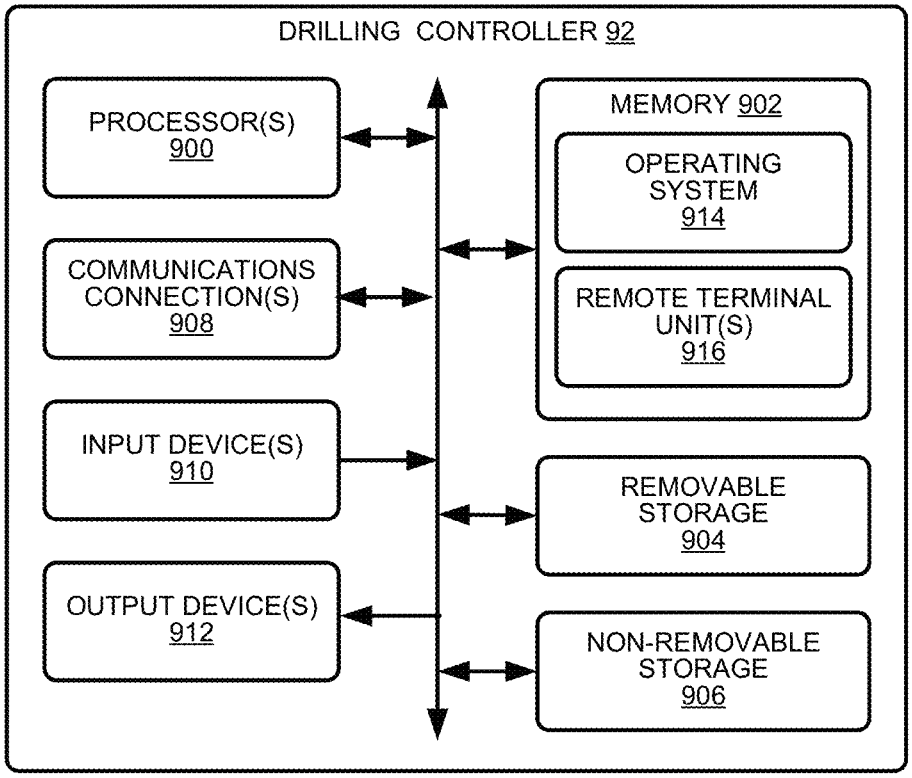
FIG. 9 is a schematic diagram of an example drilling controller configured to at least partially control a subsea well casing drilling assembly, according to embodiments of the disclosure.

FIG. 9 is a schematic diagram of an example drilling controller 92 configured to at least partially control a subsea well casing drilling assembly 12, according to embodiments of the disclosure, for example, as described herein. The drilling controller 92 may include one or more processor(s) 900 configured to execute certain operational aspects associated with implementing certain systems and methods described herein. The processor(s) 900 may communicate with a memory 902. The processor(s) 900 may be implemented and operated using appropriate hardware, software, firmware, or combinations thereof. Software or firmware implementations may include computer-executable or machine-executable instructions written in any suitable programming language to perform the various functions described. In some examples, instructions associated with a function block language may be stored in the memory 902 and executed by the processor(s) 900.

The memory 902 may be used to store program instructions that are loadable and executable by the processor(s) 900, as well as to store data generated during the execution of these programs. Depending on the configuration and type of the drilling controller 92, the memory 902 may be volatile (such as random access memory (RAM)) and/or non-volatile (such as read-only memory (ROM), flash memory, etc.). In some examples, the memory devices may include additional removable storage 904 and/or non-removable storage 906 including, but not limited to, magnetic storage, optical disks, and/or tape storage. The disk drives and their associated computer-readable media may provide non-volatile storage of computer-readable instructions, data structures, program modules, and other data for the devices. In some implementations, the memory 902 may include multiple different types of memory, such as static random access memory (SRAM), dynamic random access memory (DRAM), or ROM.

The memory 902, the removable storage 904, and the non-removable storage 906 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

The drilling controller 92 may also include one or more communication connection(s) 908 that may facilitate a control device (not shown) to communicate with devices or equipment capable of communicating with the drilling controller 92. The drilling controller 92 may also include a computer system (not shown). Connections may also be established via various data communication channels or ports, such as USB or COM ports to receive cables connecting the drilling controller 92 to various other devices on a network. In some examples, the drilling controller 92 may include Ethernet drivers that enable the drilling controller 92 to communicate with other devices on the network. According to various examples, communication connections 908 may be established via a wired and/or wireless connection on the network.

The drilling controller 92 may also include one or more input devices 910, such as a keyboard, mouse, pen, voice input device, gesture input device, and/or touch input device. It may further include one or more output devices 912, such as a display, printer, and/or speakers. In some examples, computer-readable communication media may include computer-readable instructions, program modules, or other data transmitted within a data signal, such as a carrier wave or other transmission. As used herein, however, computer-readable storage media may not include computer-readable communication media.

Turning to the contents of the memory 902, the memory 902 may include, but is not limited to, an operating system (OS) 914 and one or more application programs or services for implementing the features and embodiments disclosed herein. Such applications or services may include remote terminal units 916 for executing certain systems and methods for controlling operation of the subsea well casing drilling assembly 12 (e.g., semi- or full-autonomously controlling operation of the subsea well casing drilling assembly 12), for example, upon receipt of one or more control signals generated by the drilling controller 92. In some embodiments, one or more remote terminal unit(s) 916 may be located on the drilling rig 14. The remote terminal unit(s) 916 may reside in the memory 902 or may be independent of the drilling controller 92. In some examples, the remote terminal unit(s) 916 may be implemented by software that may be provided in configurable control block language and may be stored in non-volatile memory. When executed by the processor(s) 900, the remote terminal unit(s) 916 may implement the various functionalities and features associated with the drilling controller 92 described herein.

As desired, embodiments of the disclosure may include a drilling controller 92 with more or fewer components than are illustrated in FIG. 9. Additionally, certain components of the example drilling controller 92 shown in FIG. 9 may be combined in various embodiments of the disclosure. The drilling controller 92 of FIG. 9 is provided by way of example only.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including handheld devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

Having now described some illustrative embodiments of the disclosure, it should be apparent to those skilled in the art that the foregoing is merely illustrative and not limiting, having been presented by way of example only. Numerous modifications and other embodiments are within the scope of one of ordinary skill in the art and are contemplated as falling within the scope of the disclosure. In particular, although many of the examples presented herein involve specific combinations of method acts or system elements, it should be understood that those acts and those elements may be combined in other ways to accomplish the same objectives. Those skilled in the art should appreciate that the parameters and configurations described herein are exemplary and that actual parameters and/or configurations will depend on the specific application in which the systems, methods, and/or aspects or techniques of the disclosure are used. Those skilled in the art should also recognize or be able to ascertain, using no more than routine experimentation, equivalents to the specific embodiments of the disclosure. It is, therefore, to be understood that the embodiments described herein are presented by way of example only and that, within the scope of any appended claims and equivalents thereto, the disclosure may be practiced other than as specifically described.

This U.S. provisional patent application claims priority to and the benefit of U.S. Provisional Application No. 63/263,185, filed Oct. 28, 2021, titled "SYSTEMS AND METHODS FOR CASING DRILLING SUBSEA WELLS," U.S. Provisional Application No. 63/262,450, filed Oct. 13, 2021, titled "SYSTEMS AND METHODS FOR CASING DRILLING SUBSEA WELLS," and U.S. Provisional Application No. 63/203,954, filed Aug. 5, 2021, titled "SYSTEMS AND METHODS FOR CASING DRILLING SUBSEA WELLS," the disclosures of which are incorporated herein by reference in their entireties.

Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further may be made thereto without departing from the spirit and scope of the present disclosure as set forth in the appended claims.

What is claimed is:

1. A method for casing drilling riserless sections of a subsea well, the method comprising:

casing drilling a section of a wellbore for a casing of the subsea well to a predetermined depth;

while casing drilling the section of the wellbore, obtaining information indicative of pore pressure and fracture pressure of a geological formation through which the section is casing drilled;

determining a pressure range based at least in part on the pore pressure, the fracture pressure, and a modification to mechanical properties of the geological formation due to the casing drilling of the section, the determining a pressure range comprising determining a post-drilling fracture pressure of the section following the casing drilling based at least in part on the modification to the mechanical properties of the geological formation and adjusting the fracture pressure based at least in part on the post-drilling fracture pressure; and selecting, based at least in part on the pressure range and the predetermined depth, a pressure of the wellbore for casing drilling the section.

2. The method of claim 1, wherein the predetermined depth is a first predetermined depth, the casing is a first casing, and the section is a first section, the method further comprising:

casing drilling a first casing seat at the first predetermined depth;

casing drilling a second section of the wellbore for a second casing of the subsea well from the first casing seat to a second predetermined depth;

while casing drilling the second section of the wellbore, obtaining information indicative of pore pressure and fracture pressure of a geological formation through which the second section is casing drilled;

determining a second pressure range based at least in part on the pore pressure and the fracture pressure of the geological formation through which the second section is casing drilled, and a modification to mechanical properties of the geological formation through which the second section is casing drilled due to the casing drilling of the second section; and selecting, based at least in part on the second pressure range and the second predetermined depth, a second pressure of the wellbore for casing drilling the second section.

3. The method of claim 2, further comprising determining the second predetermined depth, wherein determining the second predetermined depth comprises:

determining a first fracture gradient at a first true vertical depth of the first casing seat;

determining a second true vertical depth at which the pore pressure approaches the first fracture gradient; and determining the second predetermined depth based at least in part on the second true vertical depth.

4. The method of claim 2, further comprising:

casing drilling a second casing seat at the second predetermined depth;

casing drilling a third section of the wellbore for a third casing of the subsea well from the second casing seat to a third predetermined depth;

while casing drilling the third section of the wellbore, obtaining information indicative of pore pressure and fracture pressure of a geological formation through which the third section is casing drilled;

determining a third pressure range based at least in part on the pore pressure and the fracture pressure of the geological formation through which the third section is casing drilled, and a modification to mechanical properties of the geological formation through which the third section is casing drilled due to the casing drilling of the third section; and selecting, based at least in part on the third pressure range, the third predetermined depth and a third pressure of the wellbore for casing drilling the third section.

5. The method of claim 4, further comprising determining the third predetermined depth, wherein determining the third predetermined depth comprises:

determining a first fracture gradient at a first true vertical depth of the first casing seat;

determining a second true vertical depth at which a pore pressure approaches the first fracture gradient;

setting the second predetermined depth based at least in part on the second true vertical depth;

determining a second fracture gradient at the second true vertical depth of the second casing seat;

determining a third true vertical depth at which a pore pressure approaches the second fracture gradient; and determining the third predetermined depth based at least in part on the third true vertical depth.

6. The method of claim 1, wherein casing drilling the section comprises increasing the fracture pressure of the section via smearing of drilling cuttings into a wall of the wellbore, and the method further comprises determining one or more of the predetermined depth, the pore pressure, or the fracture pressure associated with the section prior to casing drilling the section.

7. The method of claim 1, wherein one or more of:

casing drilling the section for the casing of the subsea well to the predetermined depth comprises casing drilling through a geological hazard; or the casing comprises a structural casing positioned to axially support one or more of a wellhead, riser, or blowout preventer, and wherein the predetermined depth is based at least in part on a depth at which the pore pressure exceeds a gradient of one or more of fresh water or salt water.

8. A subsea well casing drilling assembly comprising:

a casing string comprising a tubular wall to provide a barrier between a flow of one or more of drilling fluids or hydrocarbons from a subsea geological formation and a wellbore traversing a portion of the subsea geological formation;

a drive assembly received in the casing string, the drive assembly comprising:

a driven interface positioned to be connected to a running string supported by a drilling rig including rotating equipment positioned to rotate the running string;

a casing interface connected to an interior surface of the casing string and positioned to transfer rotation between the drive assembly and the casing string;

a cementing string interface positioned to be connected to a cementing string; and a tubular drive body extending at least partially between the driven interface and the cementing string interface and being positioned to receive drilling fluids therethrough;

a cementing string connected to the cementing string interface and positioned to provide fluid flow between the drive assembly and a terminal end of the casing string;

a casing bit connected to the terminal end of the casing string, the casing bit being positioned to rotate with the casing string and drill into the geological formation to form a wellbore traversing a section of the geological formation; and one or more drilling sensors positioned to generate one or more drilling signals indicative of one or more of pressure, flow rate, temperature, well depth, or lithology; and a drilling controller in communication with one or more of the drilling rig, the drive assembly, or the one or more drilling sensors, the drilling controller being configured to:

receive the one or more drilling signals from the one or more drilling sensors;

determine, based at least in part on the one or more drilling signals, information indicative of pore pressure and fracture pressure of a geological formation through which a section of a wellbore for a casing of a subsea well is being casing drilled to a predetermined depth;

determine a pressure range based at least in part on the pore pressure, the fracture pressure, and a modification to mechanical properties of the geological formation due to the casing drilling of the section, the determine a pressure range comprising determine a post-drilling fracture pressure of the section following the casing drilling based at least in part on the modification to the mechanical properties of the geological formation and adjust the fracture pressure based at least in part on the post-drilling fracture pressure;

select, based at least in part on the pressure range and the predetermined depth, a pressure of the wellbore for casing drilling the section; and at least partially control one or more of the rotating equipment or the drive assembly to casing drill the section of the wellbore to the predetermined depth.

9. The assembly of claim 8, wherein the drilling controller is configured to determine the predetermined depth based at least in part on a depth at which the pore pressure exceeds a gradient of salt water.

10. The assembly of claim 8, wherein the predetermined depth is a first predetermined depth, the casing is a first casing, the section is a first section, and the drilling controller further is configured to:

at least partially control placement of a first casing seat at the first predetermined depth;

receive one or more second drilling signals from the one or more drilling sensors;

determine, based at least in part on the one or more second drilling signals, information indicative of a second pore pressure and a second fracture pressure of the geological formation through which a second section of the wellbore for a second casing of the subsea well is being casing drilled to a second predetermined depth;

determine a second pressure range based at least in part on the second pore pressure, the second fracture pressure, and a second modification to mechanical properties of the geological formation due to the casing drilling of the second section;

select, based at least in part on the second pressure range and the second predetermined depth, a second pressure of the wellbore for casing drilling the second section; and at least partially control one or more of the rotating equipment or the drive assembly to casing drill the second section of the wellbore to the second predetermined depth.

11. The assembly of claim 10, wherein the drilling controller further is configured to:

determine a first fracture gradient at a first true vertical depth of the first casing seat;

determine a second true vertical depth at which the second pore pressure approaches the first fracture gradient; and determine the second predetermined depth based at least in part on the second true vertical depth.

12. The assembly of claim 10, wherein the drilling controller further is configured to:

at least partially control placement of a second casing seat at the second predetermined depth;

receive one or more third drilling signals from the one or more drilling sensors;

determine, based at least in part on the one or more third drilling signals, information indicative of a third pore pressure and a third fracture pressure of the geological formation through which a third section of the wellbore for a third casing of the subsea well is being casing drilled to a third predetermined depth;

determine a third pressure range based at least in part on the third pore pressure, the third fracture pressure, and a third modification to mechanical properties of the geological formation due to the casing drilling of the third section;

select, based at least in part on the third pressure range and the third predetermined depth, a third pressure of the wellbore for casing drilling the third section; and at least partially control one or more of the rotating equipment or the drive assembly to casing drill the third section of the wellbore.

13. The assembly of claim 12, wherein the drilling controller further is configured to:

determine the first fracture gradient at a first true vertical depth of the first casing seat;

determine a second true vertical depth at which the second pore pressure approaches the first fracture gradient;

set the second predetermined depth based at least in part on the second true vertical depth;

determine the second fracture gradient at the second true vertical depth of the second casing seat;

determine a third true vertical depth at which the third pore pressure approaches the second fracture gradient; and determine the third predetermined depth based at least in part on the third true vertical depth.

14. The assembly of claim 8, wherein the drilling controller is configured to receive signals indicative of one or more of drilling information or geological formation information from a remote source, and at least partially control, based at least in part on the one or more of the drilling information or geological formation information, the one or more of the rotating equipment or the drive assembly to casing drill the section of the wellbore.

15. The assembly of claim 8, wherein the drilling controller is further configured to at least partially control, based at least in part on the one or more drilling signals, flow of drilling fluid through the cementing string.

16. A subsea casing drilling assembly to provide a bore traversing a portion of a subsea geological formation, the subsea casing drilling assembly comprising:

a drive assembly positioned to be received in a casing string, the drive assembly comprising:

a driven interface positioned to be connected to a running string supported by a drilling rig including rotating equipment positioned to rotate the running string;

a casing interface positioned to be connected to an interior surface of the casing string and positioned to transfer rotation between the drive assembly and the casing string;

a cementing string interface positioned to be connected to a cementing string; and a tubular drive body extending at least partially between the driven interface and the cementing string interface and being positioned to receive drilling fluids therethrough;

a cementing string connected to the cementing string interface and positioned to provide fluid flow between the drive assembly and a terminal end of the casing string;

a casing bit positioned to be connected to a terminal end of the casing string, the casing bit being positioned to rotate with the casing string and drill into the subsea geological formation to form a section of a bore traversing a section of the subsea geological formation through which the section of the bore for a casing of the bore is being casing drilled to a predetermined depth; and a drilling controller configured to:

(i) receive one or more signals indicative of pore pressure of the subsea geological formation;

(ii) receive one or more signals indicative of fracture pressure of the section of the subsea geological formation;

(iii) receive one or more signals indicative of a modification to mechanical properties of the section of the subsea geological formation;

(iv) determine a post-drilling fracture pressure of the section of the subsea geological formation based at least in part on the modification to mechanical properties of the section of the geological formation; and (v) adjust the fracture pressure based at least in part on the post-drilling fracture pressure.

17. The subsea casing drilling assembly of claim 16, wherein the casing string comprises a tubular wall to provide a barrier between the interior surface of the casing string and the section of the bore traversing the section of the subsea geological formation, and the subsea casing drilling assembly further comprises:

a low pressure housing connected adjacent a first end of the casing string closest to the drilling rig; and a debris barrier below the low pressure housing and positioned to prevent drilling debris from entering the casing string.

18. The subsea casing drilling assembly of claim 16, further comprising:

a low pressure housing connected adjacent a first end of the casing string closest to the drilling rig; and a debris barrier positioned to prevent drilling debris from entering the casing string, wherein the debris barrier is one:

above the low pressure housing closest to the drilling rig, and wherein the bore comprises a wellbore; or the debris barrier is below the low pressure housing remote from the drilling rig, and wherein the bore comprises a wellbore.

19. The subsea casing drilling assembly of claim 16, wherein the casing interface is connected to the interior surface of the casing string and positioned to transfer rotation between the drive assembly and the casing string, and the assembly further comprises one or more drilling sensors positioned to generate one or more drilling signals indicative of one or more of pressure, flow rate, temperature, bore depth, or lithology.

20. The subsea casing drilling assembly of claim 19, wherein the drilling controller is configured to:

receive the one or more drilling signals from the one or more drilling sensors;

determine, based at least in part on the one or more drilling signals, information indicative of pore pressure and fracture pressure of the section of the subsea geological formation;

select, based at least in part on the pressure range and the predetermined depth, a pressure of the bore for casing drilling the section; and at least partially control one or more of the rotating equipment or the drive assembly to casing drill the section of the bore to the predetermined depth.

21. A method for casing drilling a subsea bore, the method comprising:

casing drilling a section of a bore for a casing of the subsea bore to a predetermined depth;

while casing drilling the section of the bore, obtaining information indicative of pore pressure and fracture pressure of a geological formation through which the section is casing drilled;

determining a pressure range based at least in part on the pore pressure, the fracture pressure, and a modification to mechanical properties of the geological formation due to the casing drilling of the section, the determining a pressure range comprising determining a post-drilling fracture pressure of the section following the casing drilling based at least in part on the modification to the mechanical properties of the geological formation and adjusting the fracture pressure based at least in part on the post-drilling fracture pressure; and selecting, based at least in part on the pressure range and the predetermined depth, a pressure of the bore for casing drilling the section.

22. The method of claim 21, wherein the predetermined depth is a first predetermined depth, the casing is a first casing, and the section is a first section, the method further comprising:

placing a first casing seat at the first predetermined depth;

casing drilling a second section of the bore for a second casing of the subsea bore from the first casing seat to a second predetermined depth;

while casing drilling the second section of the bore, obtaining information indicative of pore pressure and fracture pressure of a geological formation through which the second section is casing drilled;

determining a second pressure range based at least in part on the pore pressure and the fracture pressure of the geological formation through which the second section is casing drilled, and a modification to mechanical properties of the geological formation through which the second section is casing drilled due to the casing drilling of the second section; and selecting, based at least in part on the second pressure range and the second predetermined depth, a second pressure of the bore for casing drilling the second section.

23. The method of claim 22, further comprising determining the second predetermined depth, wherein determining the second predetermined depth comprises:

determining a first fracture gradient at a first true vertical depth of the first casing seat;

determining a second true vertical depth at which the pore pressure approaches the first fracture gradient; and determining the second predetermined depth based at least in part on the second true vertical depth.

24. The method of claim 22, further comprising:

placing a second casing seat at the second predetermined depth;

casing drilling a third section of the bore for a third casing of the subsea bore from the second casing seat to a third predetermined depth;

while casing drilling the third section of the bore, obtaining information indicative of pore pressure and fracture pressure of a geological formation through which the third section is casing drilled;

determining a third pressure range based at least in part on the pore pressure and the fracture pressure of the geological formation through which the third section is casing drilled, and a modification to mechanical properties of the geological formation through which the third section is casing drilled due to the casing drilling of the third section; and selecting, based at least in part on the third pressure range, the third predetermined depth and a third pressure of the bore for casing drilling the third section.

25. The method of claim 24, further comprising determining the third predetermined depth, wherein determining the third predetermined depth comprises:

determining a first fracture gradient at a first true vertical depth of the first casing seat;

determining a second true vertical depth at which a pore pressure approaches the first fracture gradient;

setting the second predetermined depth based at least in part on the second true vertical depth;

determining a second fracture gradient at the second true vertical depth of the second casing seat;

determining a third true vertical depth at which a pore pressure approaches the second fracture gradient; and determining the third predetermined depth based at least in part on the third true vertical depth.

26. The method of claim 21, wherein determining the pressure range comprises estimating a post-drilling fracture pressure of the section following the casing drilling and adjusting the fracture pressure based at least in part on the post-drilling fracture pressure.

27. The method of claim 21, wherein casing drilling the section comprises increasing the fracture pressure of the section via smearing of drilling cuttings into a wall of the bore.

28. The method of claim 21, further comprising determining one or more of the predetermined depth, the pore pressure, or the fracture pressure associated with the section prior to casing drilling the section.

29. The method of claim 21, wherein casing drilling the section for the casing of the subsea bore to the predetermined depth comprises casing drilling through a geological hazard.

30. The method of claim 21, wherein the predetermined depth is based at least in part on a depth at which the pore pressure exceeds a gradient of one or more of fresh water or salt water.

* * * * *